US012150560B2

(12) United States Patent
Warner

(10) Patent No.: US 12,150,560 B2
(45) Date of Patent: Nov. 26, 2024

(54) MULTIPLE POSITION BABY CARRIER

(71) Applicant: Angelique N. Warner, Hazel Crest, IL (US)

(72) Inventor: Angelique N. Warner, Hazel Crest, IL (US)

( * ) Notice: Subject to any disclaimer, the term of this patent is extended or adjusted under 35 U.S.C. 154(b) by 133 days.

(21) Appl. No.: 17/677,861

(22) Filed: Feb. 22, 2022

(65) Prior Publication Data

US 2022/0175152 A1 Jun. 9, 2022

Related U.S. Application Data

(63) Continuation of application No. 16/161,004, filed on Oct. 15, 2018, now Pat. No. 11,272,791.

(60) Provisional application No. 62/572,476, filed on Oct. 14, 2017.

(51) Int. Cl.
*A47D 13/02* (2006.01)
*A45F 3/04* (2006.01)

(52) U.S. Cl.
CPC ..... *A47D 13/02* (2013.01); *A45F 3/04* (2013.01); *A45F 2003/045* (2013.01)

(58) Field of Classification Search
CPC ..... A47D 13/02; A47D 13/025; A45F 3/04; A45F 2003/045
See application file for complete search history.

(56) References Cited

U.S. PATENT DOCUMENTS 4,469,259 A 9/1984 Krich et al.
4,579,264 A 4/1986 Napolitano
5,011,057 A 4/1991 Perruzza et al.
5,333,769 A 8/1994 Skroski
5,570,823 A 11/1996 Lindy
5,673,828 A 10/1997 Raedel et al.
5,678,739 A 10/1997 Darling et al.
5,927,576 A 7/1999 Nielsen
6,257,468 B1 7/2001 Yamazoe et al.
7,661,566 B2 2/2010 Yoshie et al.
10,736,436 B2 8/2020 Telford
2005/0045674 A1 3/2005 Rehbein
2007/0029356 A1 2/2007 Moriguchi et al.
2007/0284403 A1 12/2007 Minami et al.
2010/0072236 A1 3/2010 Parness et al.
2010/0155446 A1 6/2010 Stein et al.
2010/0170927 A1 7/2010 Warner
2010/0187268 A1 7/2010 Rosen et al.
2011/0079622 A1 4/2011 Muehlen
2012/0145754 A1 6/2012 Green
(Continued)

OTHER PUBLICATIONS

"Nurse N Go Carrier Photoshoot" COTA for Miles B. Web page <https://cota.org/campaigns/COTAforMilesB/photos/Nurse-N-Go-Carrier-PhotoShoot> Jan. 1, 2017.
(Continued)

*Primary Examiner* — Corey N Skurdal
(74) *Attorney, Agent, or Firm* — Quarles & Brady LLP

(57) ABSTRACT

A carrier for holding an infant is disclosed. The carrier includes: a carriage assembly and a back support assembly removably connected to the carriage assembly. The carriage assembly includes an adjustable carriage pocket. The size of the adjustable carriage pocket is adjustable to support the infant in a cradle position in which a direction from a head of the infant to a hip of the infant is substantially perpendicular to a direction from a head of a user to a hip of the user. Other aspects, embodiments, and features are also claimed and described.

19 Claims, 24 Drawing Sheets

(56) References Cited

U.S. PATENT DOCUMENTS

| | | | |
|---|---|---|---|
| 2012/0217273 | A1 | 8/2012 | Gunter et al. |
| 2013/0068805 | A1 | 3/2013 | Warner |
| 2014/0263491 | A1 | 9/2014 | Telford et al. |

OTHER PUBLICATIONS

"Nurse 'N Go Gets a New Name and a New Look" Entrenuity. Web page <https://www.entrenuity.com/news-archive/nurse-n-go-gets-a-new-name-and-a-new-look> Aug. 2017.

"Entrenuity Spotlight Update" Web page <https://scontent—ort2-2.xx.fbcdn.net/v/t1.6435-9/66129122_263120138022481 8_4922123750616334336_n.png?_nc_cat=109&ccb=1-3&_nc_sid=8024bb&efg=eyJpljoidCJ9&_nc_ohc=qmAuTQalZrQAX97xy31&_nc_ht=scontentprt2-2.xx&oh=4bce8a4ea29e1e5a71de4b742e9612ed&oe=60B180E7> Oct. 2017.

"Gear N Gadgets for Babies Instagram Posts." Web page <https://www.picuki.com/tag/gearngadgetsforbabies> p. 4, Oct. 2018. [Accessed from the internet May 6, 2021.]

"Nurse 'N Go Product Page" Web page <https://www.gogovie.com/product-page/nurse-n-go> 2017.

Tolchin, "Movable Feast", Inventor's Digest, vol. 32, Issue 5, pp. 23-25. <https://docs.wixstatic.com/ugd/d174302_aa073aa8d7114a31ae15baab3225af00.pdf> May 2016.

Teri Karl. "NurseNGo Demo", YouTube, Aug. 15, 2016, (video online). [Retrieved from the internet on May 10, 2021, <https://www.youtube.com/watch?v=mzAoSxe8EQA&list=LLbreLkFVysvtl_wuE0snxSw&index=44>].

Rnirroremiaj. "Nurse 'N Go Demonstration Video," YouTube, May 10, 2016, (video online). [Retrieved from the internet on May 10, 2021, <https://www.youtube.com/watch?v=8nQUVjp-JRQ&t=115s>].

Rnirroremiaj. "Nurse 'N Go Promo," YouTube, May 10, 2016, (video online). [Retrieved from the internet on May 10, 2021, <https://www.youtube.com/watch?v=hnLMUWPSsqM>].

Rnirroremiaj. "Nurse N' Go Testimonials," YouTube, May 10, 2016, (video online). [Retrieved from the internet on May 10, 2021, https://www.youtube.com/watch?v=_T_nJJzPb3Q>].

GoGoVie. "GoGoVie demo," YouTube, Jul. 6, 2017, (video online). [Retrieved from the internet on May 10, 2021, <https://youtu.be/1-7UinTyyh0>].

Terry Ward, "Baby Sling vs. Baby Carrier vs. Baby Wrap: What's the Difference?" Dec. 7, 2020; Family Vacation Critic: Web page <https://www.familyvacationcritic.com/baby-sling-v-baby-carrier-v-baby-wrap/art/> [Retrieved from the internet on Feb. 18, 2022].

MULTIPLE POSITION BABY CARRIER

This non-provisional application entitled "Multiple Position Baby Carrier" is a continuation of U.S. patent application Ser. No. 16/161,004 filed Oct. 15, 2018, which claims priority to U.S. Provisional Patent Application No. 62/572,476 entitled "Multiple Position Baby Carrier" filed on Oct. 14, 2017.

TECHNICAL FIELD

Various exemplary embodiments disclosed herein relate generally to a baby carrier, and more particularly to a multiple position baby carrier including a baby harnessing assembly configured to permit the user to support a baby therein in multiple positions, more specifically seven or more positions within the carrier.

BACKGROUND

Conventional nursing carriers are provided for the purpose of helping a user support a baby close to the body, while a baby nurses. As a typical baby has the propensity to move around when laying in the nursing carrier, and during nursing, the one typical problem is that most nursing carriers do not provide a mechanism ensuring that the baby is secured within the nursing carrier, permitting the mother to nurse a baby in the nursing carrier. Baby Carriers are generally a fabric device meant to hold or attach a baby to the body of a caregiver in a position that mimics in arms carrying positions. Carriers encompass slings and wraps (as well as soft carriers, attached with buckles, ties or other fasteners) as well as frame style carriers.

Most baby nursing carriers do not permit a baby to be secured in multiple positions facing opposing directions, permitting the mother to alternate breasts from which the baby feeds. Accordingly, it is desirable to provide a baby nursing carrier having an interchangeable cover for properly covering the baby from exposure during nursing. It is further desirable to provide a baby nursing carrier and further includes dual harnessing within the carriage, enabling a user to position the baby within the nursing carrier in multiple directions, facilitating feeding from either breast.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation that may be apparent to those skilled in the art. Accordingly, the present invention resides in the novel methods, arrangements, combinations, and improvements herein shown and described in various exemplary embodiment.

SUMMARY

A brief summary of various exemplary embodiments is presented below. Some simplifications and omissions may be made in the following summary, which is intended to highlight and introduce some aspects of the various exemplary embodiments, but not to limit the scope of the invention. Detailed descriptions of an exemplary embodiment adequate to allow those of ordinary skill in the art to make and use the inventive concepts will follow in later sections.

Various exemplary embodiments relate to a baby carrier. The baby nursing carrier includes a back support assembly configured to secure the nursing carrier to the back portion of a user and a cradle assembly positioned generally at a front portion of the nursing carrier.

The multiple position baby carrier is configured for positioning the baby relative to the user in at least seven (7) different support positions. The multiple position baby carrier also includes a removably attachable cover assembly connectable to a portion of the cradle assembly and configured to extend generally about the frontal portion of user, covering baby and frontal region of the user.

BRIEF DESCRIPTION OF THE DRAWINGS

In order to better understand various exemplary embodiments, reference is made to the accompanying drawings, wherein.

To facilitate understanding, identical reference numerals have been used to designate elements having substantially the same or similar structure and/or substantially the same or similar function.

DETAILED DESCRIPTION

For simplicity and illustrative purposes, the principles are shown by way of examples of systems and methods described. In the following description, numerous specific details are set forth in order to provide a thorough understanding of the examples. It will be apparent however, to one of ordinary skill in the art, that the examples may be practiced without limitation to these specific details. In other instances, well known methods and structures are not described in detail so as not to unnecessarily obscure understanding of the examples.

The multiple position nursing carrier 100 is adjustable to carry and/or support a baby in at least seven (7) different positions relative to the user's body, as illustrated.

Figure 1:
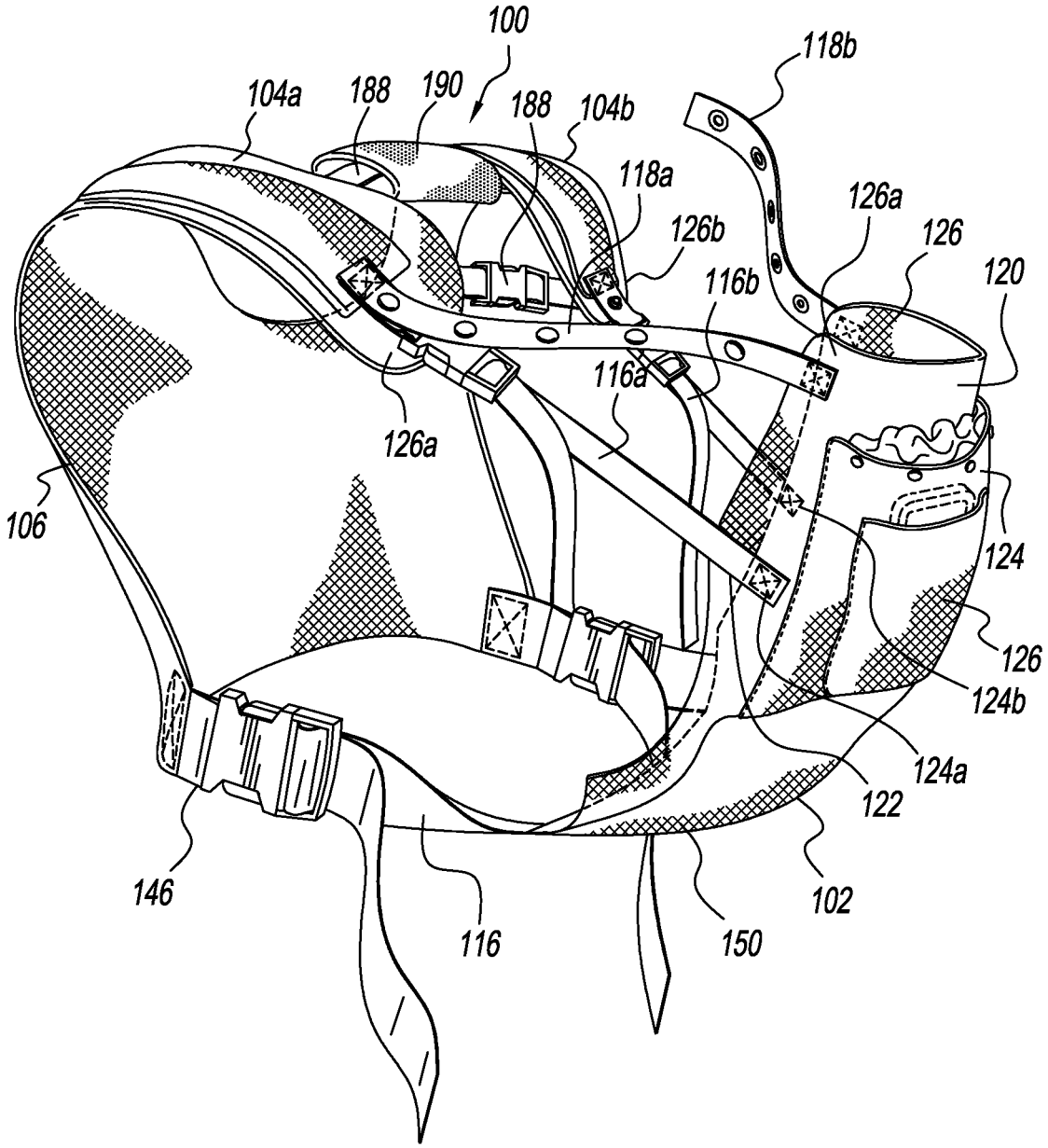
FIG. 1 illustrates one embodiment of a baby nursing carrier, showing a frontal perspective view.

FIG. 1 shows a front perspective view of the baby nursing carrier 100. As shown, the baby nursing carrier 100 includes an adjustable cradle assembly 102, including an adjustable carriage 120 provided generally in the frontal portion of the baby nursing carrier 100. The baby nursing carrier 100 further includes a vest back harness assembly 106 configured to support the nursing carrier 100 on the user's back. The vest back harness assembly 106 generally includes an adjustable torso strap assembly 146, configured to fasten the nursing carrier 100 about the user's torso. As illustrated, the torso strap assembly 146, in an extended position, further provides adjustable connection between the cradle assembly 102 and the back harness assembly 106. As such, the back harness assembly 106 supports the baby carrier 100 when the back harness assembly 106 is positioned on the user's back. The baby nursing carrier 100 further includes one or more adjustable shoulder straps 104*a*, 104*b*. As shown the shoulder straps 104*a*, 104*b* extend generally from a top portion of the vest back harness assembly 106 and is connectable to the cradle assembly 102. via adjustable strap members 118 and 116. Strap members are used to raise and lower the carriage assembly 102 relative to the user's body.

The one or more adjustable straps 118*a* and 118*b* are connected on one end to the respective shoulder straps 104*a*, 104*b* and connected to a generally upper portion of the cradle assembly 102, on opposing sides 126*a*, 126*b* of the carriage 120. The adjustable straps 118*a*, 118*b* permit the user to adjust the height of the carriage 120 relative to the user's body. Accordingly, on the occasion that the user desires to pull the baby B carriage 120 closer to the user's body, the user tightens the straps 118*a*, 118*b* and 116*a*, 116*b*. Conversely when the user wishes to allow the baby B to be supported with space in between the baby B and the user or position the baby on the user's hip, for example, the user loosens the straps 118*a*, 118*b*, 116*a* and 116*b*, lowering the carriage 120 away from the user's body.

Figure 2A:
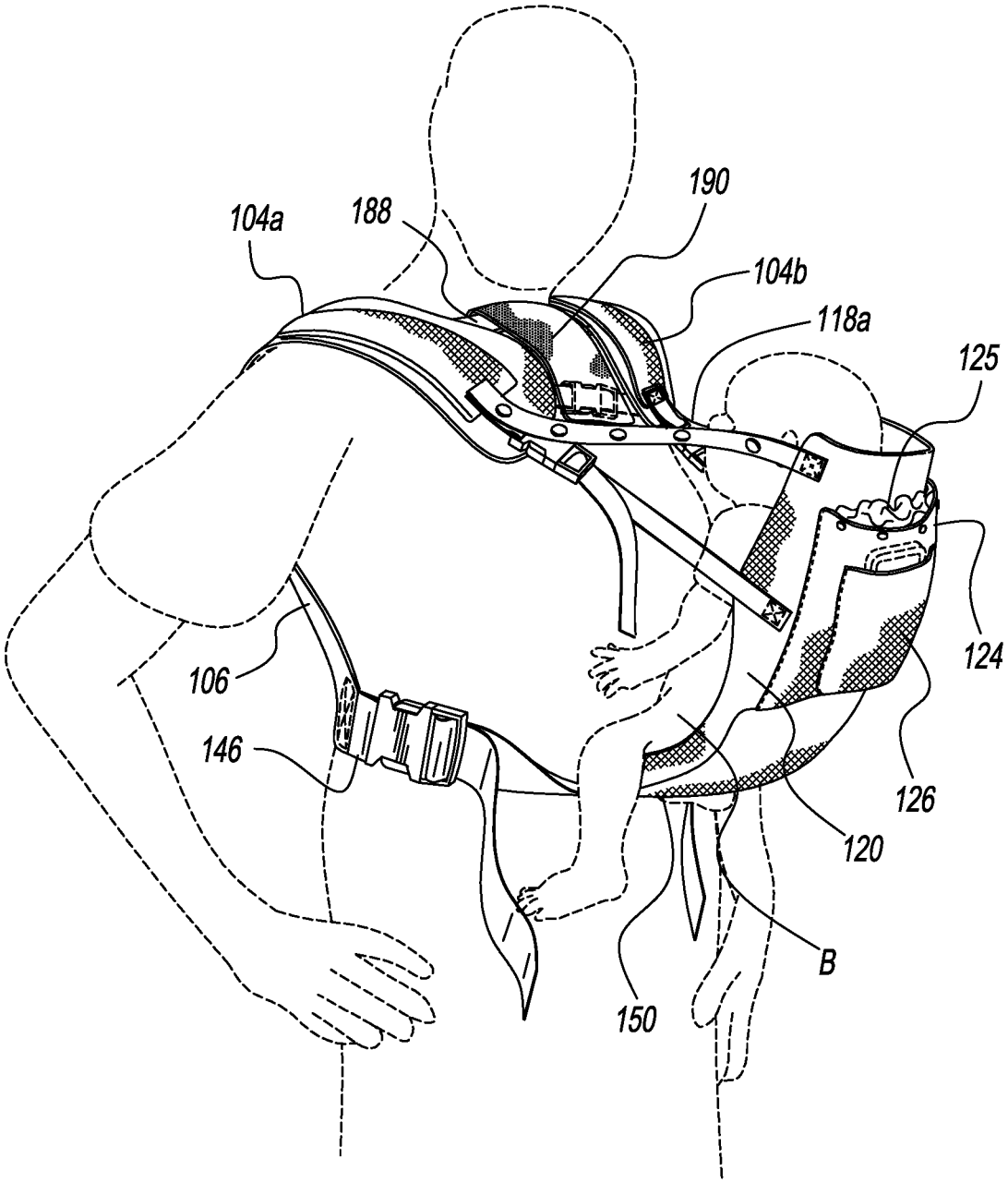
FIG. 2A Illustrates the baby nursing carrier of FIG. 1 in an extended carrier position with a cradle assembly and carriage configured to support a baby in an opposite facing position, or first position therein.
Figure 2B:
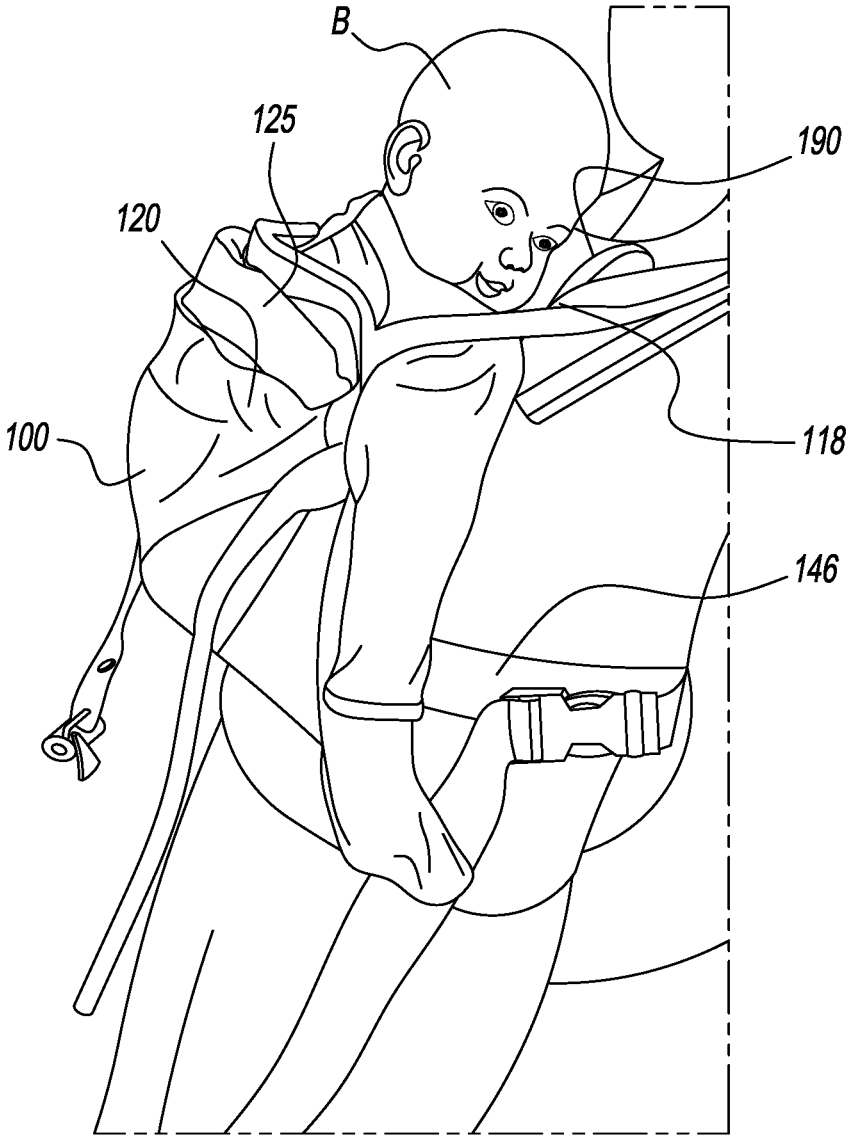
FIG. 2B Illustrates the baby nursing carrier of FIG. 1 in an extended carrier position with a cradle assembly and carriage configured to support a baby in an opposite facing position, or first position therein.

As shown in FIGS. 1 and 2A-2B, the baby may be positioned in front of the user facing the baby in an opposite facing position, or first position. The cradle assembly 102 provides an inner region configured to receive a baby B between the user's body and the carriage portion 120 of the cradle assembly 102. The frontal portion of the cradle assembly 102 provides an anchor to receive the adjustable shoulder straps 116*a* and 116*b*. As seen, the adjustable straps 116*a*, 116*b* extend from a generally respective mid portions 124*a*, 124*b* of the carriage 102 to engage respective fastening members 126*a*, 126*b* provided generally at the end portions of the respective shoulder straps 104*a*, 104*b*.

As illustrated, in the first position, strap members 146 may support the baby's legs as the baby's body, back and buttocks is positioned and supported in the in the carriage 120. A detachable cover member 125 may be deployed to cover the baby for privacy, in circumstances such as nursing. Pocket 126 may be used to carry the user's belongings, such as a PDA or cellphone. As shown in FIG. 2B, padded cover member 190 is positioned over support straps 188, proximate to the user's chest providing the baby with a place to rest his/her head.

Figure 3A:
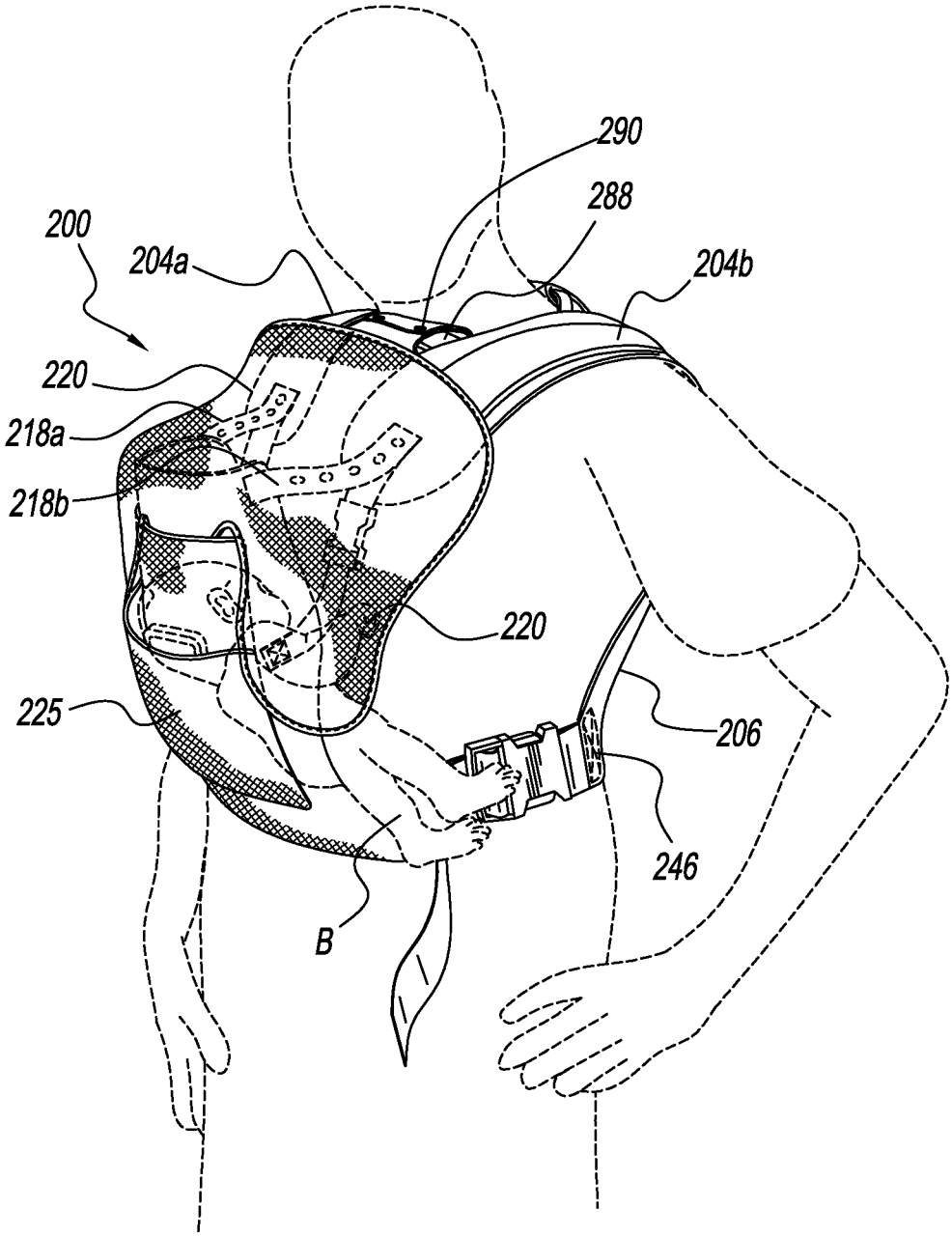
FIG. 3A illustrates a perspective view of the baby carrier of FIG. 1. Attached to the user illustrating the cradle assembly and carriage configured to support the baby in a semi-cradle position, or second position.
Figure 3B:
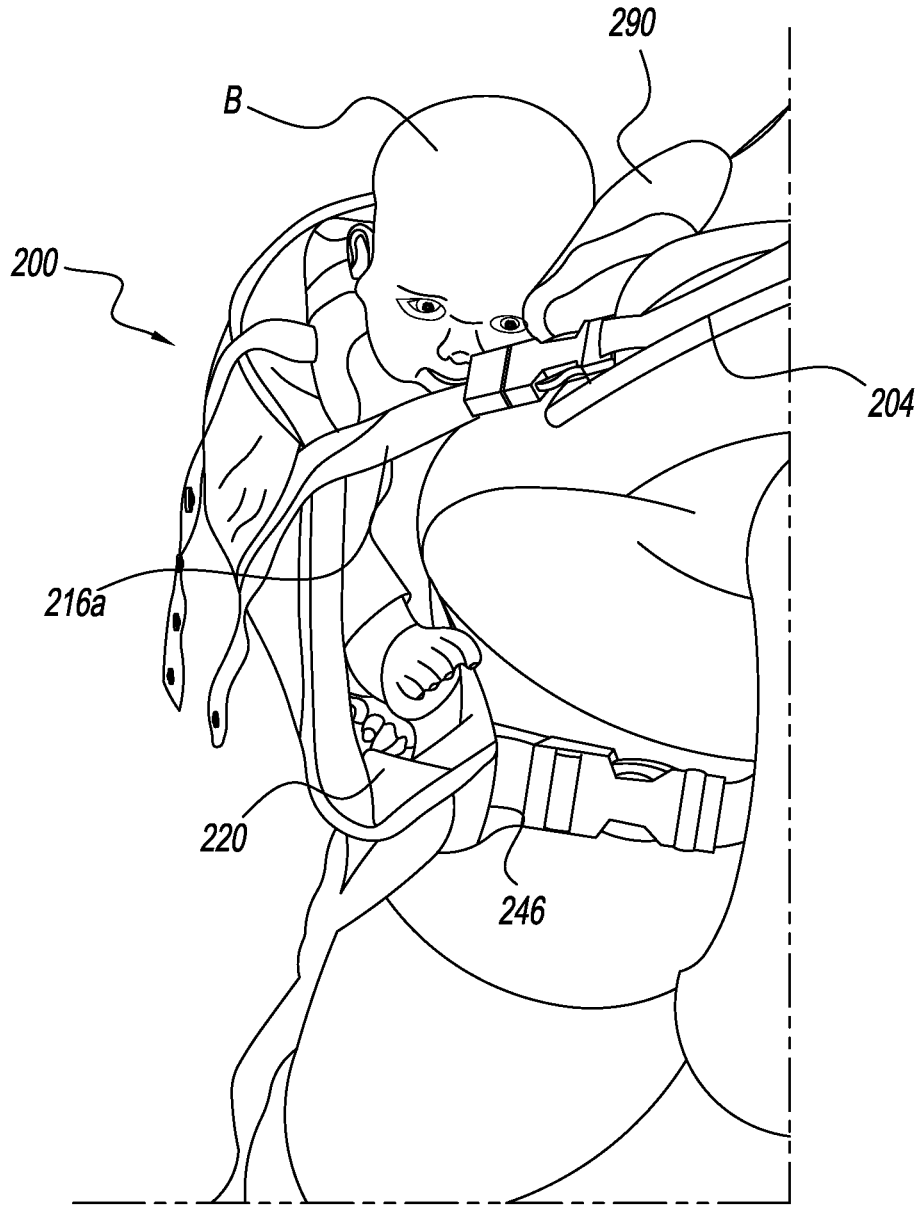
FIG. 3B illustrates a perspective view of the baby carrier of FIG. 1. attached to the user illustrating the cradle assembly and carriage configured to support the baby in a semi-cradle position, or second position.

FIGS. 3A and 3B illustrate a perspective view of the baby carrier 200 of FIG. 1. attached to the user illustrating the baby positioned in a second position, which for these purposes is referred to as supporting the baby B a semi-cradle position in the carriage 220. As illustrated in the second position, semi-cradle position, the baby is supported generally horizontally in a cradle position or upright in semi-cradle position within the carriage 220, wherein the lower portion of the baby B, such as the legs or feet, may extend out of the carriage 120, with the baby's head supported in the carriage 220. The flap members 240 of the carriage 220 support the baby's feet in an extended position or may be used to contain the feet therein.

Because of the concave inner shape of the carriage 220 with flap extensions 240 a pocket is formed for supporting the baby is positioned within the carriage 420 in a semi-upright position, with one side of the baby's body and head positioned proximate to the user's torso. As shown, the other side of the baby's body engages the inner portion of the carriage 220. The baby's head engages the cover 290 and one flap portion may be folded inside the carriage to support the baby's head and the other flap portion extends out to support the baby's legs. As illustrated, the baby's legs may extend outside of the carriage 220 or as seen, the baby's legs may be tucked or contained within the carriage 220 and flap member 240. Adjustable straps 216*a*, 216*b* may be adjusted to retract the baby B closer to the user's body.

As illustrated in FIG. 3B, in a semi-cradle position, one side of the baby engages the user's body within the carriage and the other side of the baby's body is supported by the carriage 220. The baby's head B is supported by the padded member 290 on the user's body.

Figure 4:
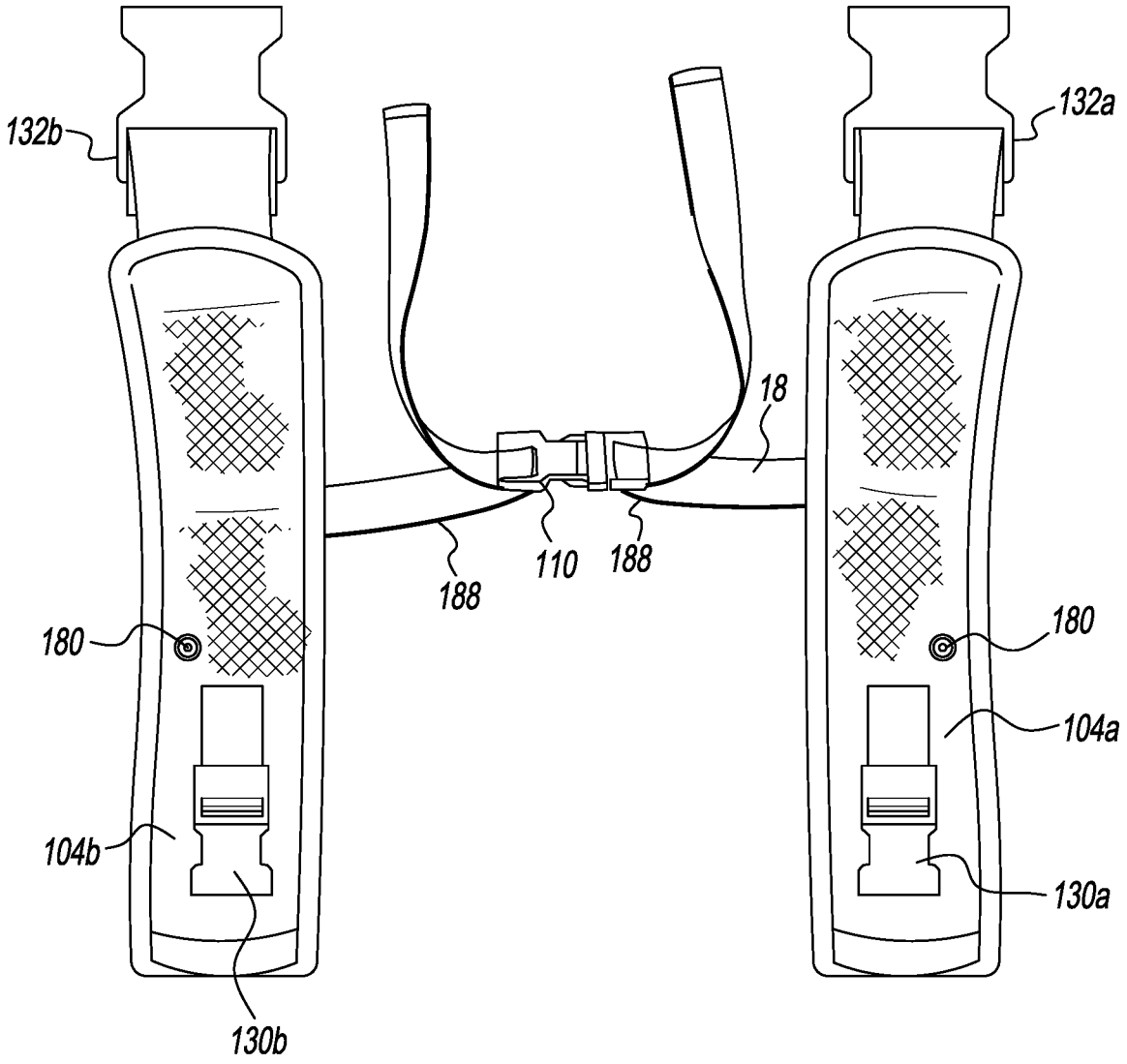
FIG. 4 further illustrates a detailed plan view of the shoulder strap members and connecting strap members of the multiple position baby carrier.
Figure 5:
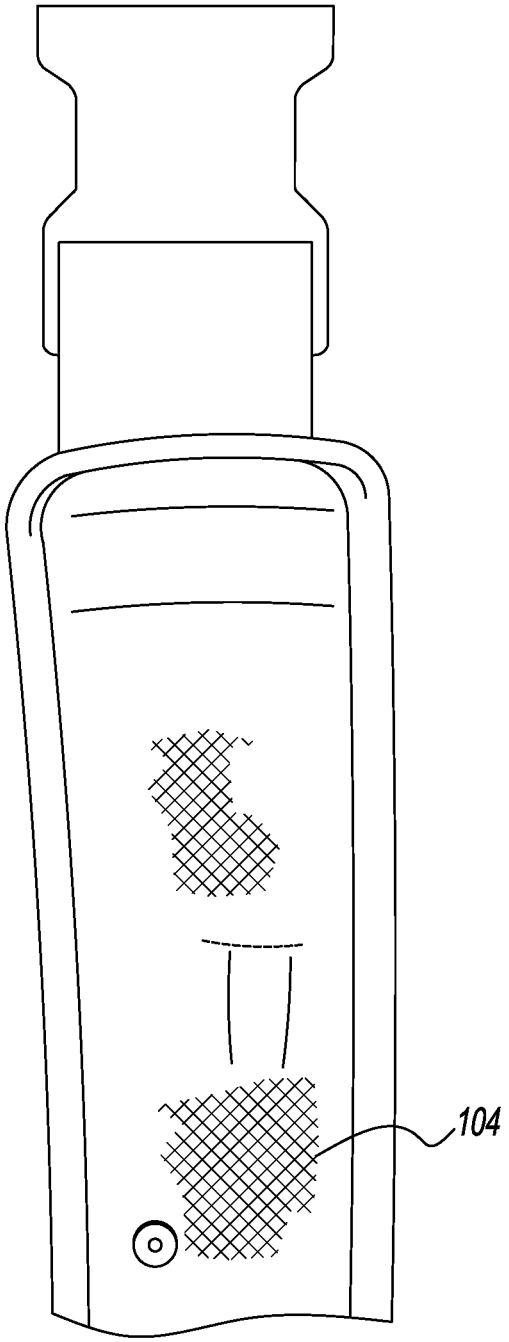
FIG. 5 a detailed view of the shoulder strap member having a male connecting member and a padded surface.
Figure 6:
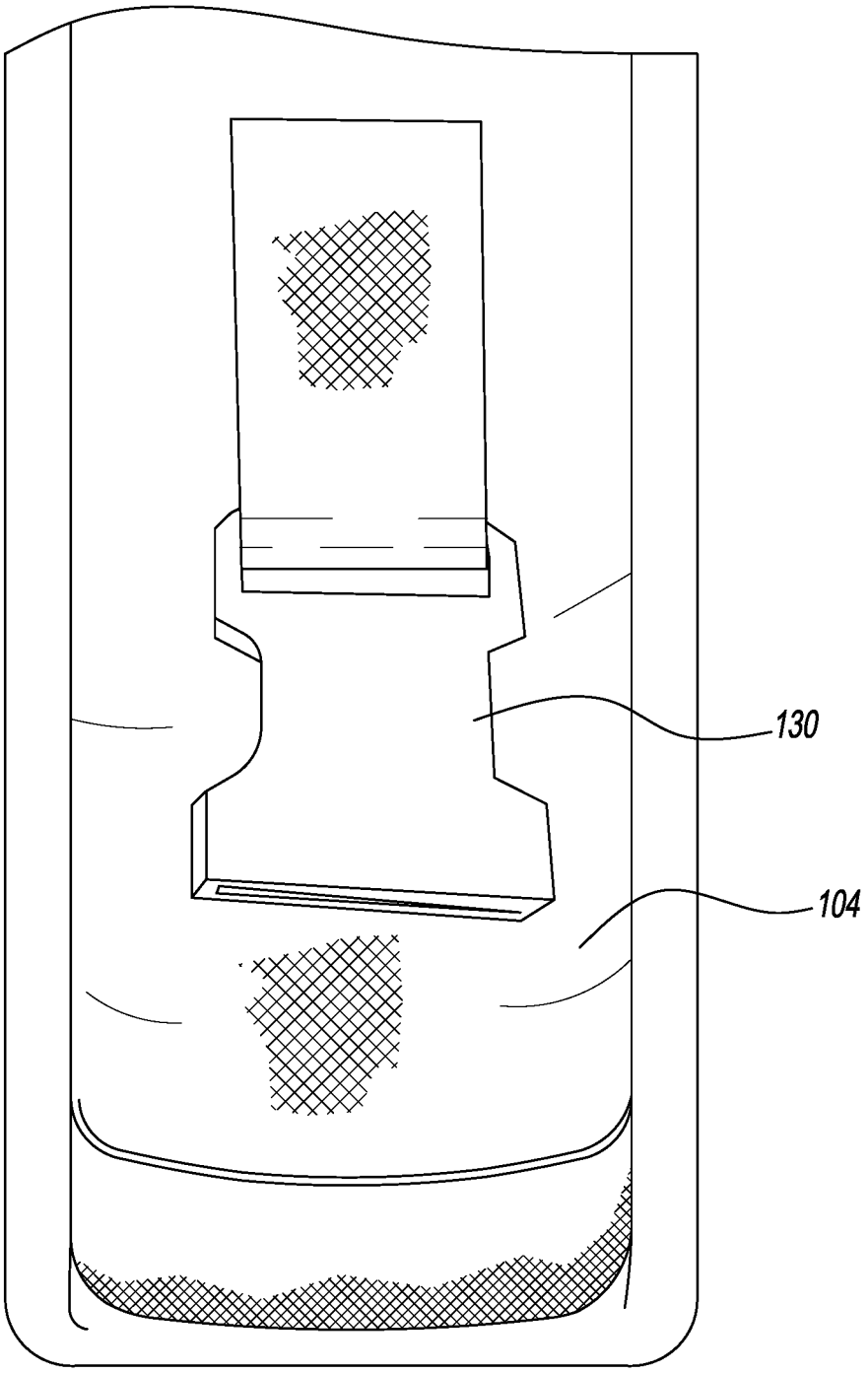
FIG. 6 is a detailed view of the shoulder strap member of FIG. 5 having a female connecting member configured to connect with adjustable straps extending from the carriage.

As illustrated in detail in FIGS. 4-6, the shoulder or back strap 104*a*, 104*b* which may be onbuhimo type strap or similar type strap suitable for supporting the baby B. As illustrated, the strap assembly 104*a*, 104*b* may include two or more padded strap portions 104*a*, generally held together, generally horizontally by a dual adjustable chest strap 110, as shown.

The nursing carrier 100 is a generally unitary device, accordingly, the straps 104 attach to the existing carrier seat carriage portion to support the baby B in a back carrier with the baby B facing the user in an opposing position, first position, shown in FIGS. 2A, 2B, 3A and 3B. It is contemplated that the straps are strong and durable enough to support the baby B of approximately six months or 22 pounds in a generally unassisted upright position. As such, the baby B has enough head and trunk control to sit unassisted, hold himself in a somewhat stable position, preventing the baby B from the risk of asphyxiation, if the baby B were to slump in a forward position.

As illustrated the strap members 104*a*, 104*b* may include one or more support buckles or fastening members 130*a*, 130*b*, which are configured to receive fastening members connected to the adjustable straps 116*a*, 116*b*. It is contemplated that the adjustable straps have a width of approximately one inch suitable to be adjustably fed through the male portion of the fastening member, which is then securable to the female member and secured to the 1" female buckles which are affixed to the straps.

As illustrated the strap members 104*a*, 104*b* may further include fastening members 132*a*, 132*b*, provided at the opposing ends of the shoulder member 104*a*, 104*b*, enabling selective adjustment of the straps. As illustrated in detail in FIG. 4, the shoulder member may include female fastening members, which are affixed to the straps shoulder members 104*a*, 104*b*, and are fastenable to corresponding male fastening members. The shoulder strap members 104*a*, 104*b* are fastenable to the 2" adjustable male buckles and webbing straps to complete the harness, referred to as an Onbu harness.

The dual adjustable shoulder straps 104*a*, 104*b* are each configured to extend over the respective user's shoulders to provided support. The adjustable shoulder straps 104*a*, 104*b* each include one or more adjusting members for adjusting the fit and dimension of the cradle assembly 102 to the user. The adjustable shoulder straps 104*a*, 104*b* including an adjustable webbing portion on each respective shoulder strap and may be attachable to the inner carriage portion inside of the front pocket.

Figure 7:
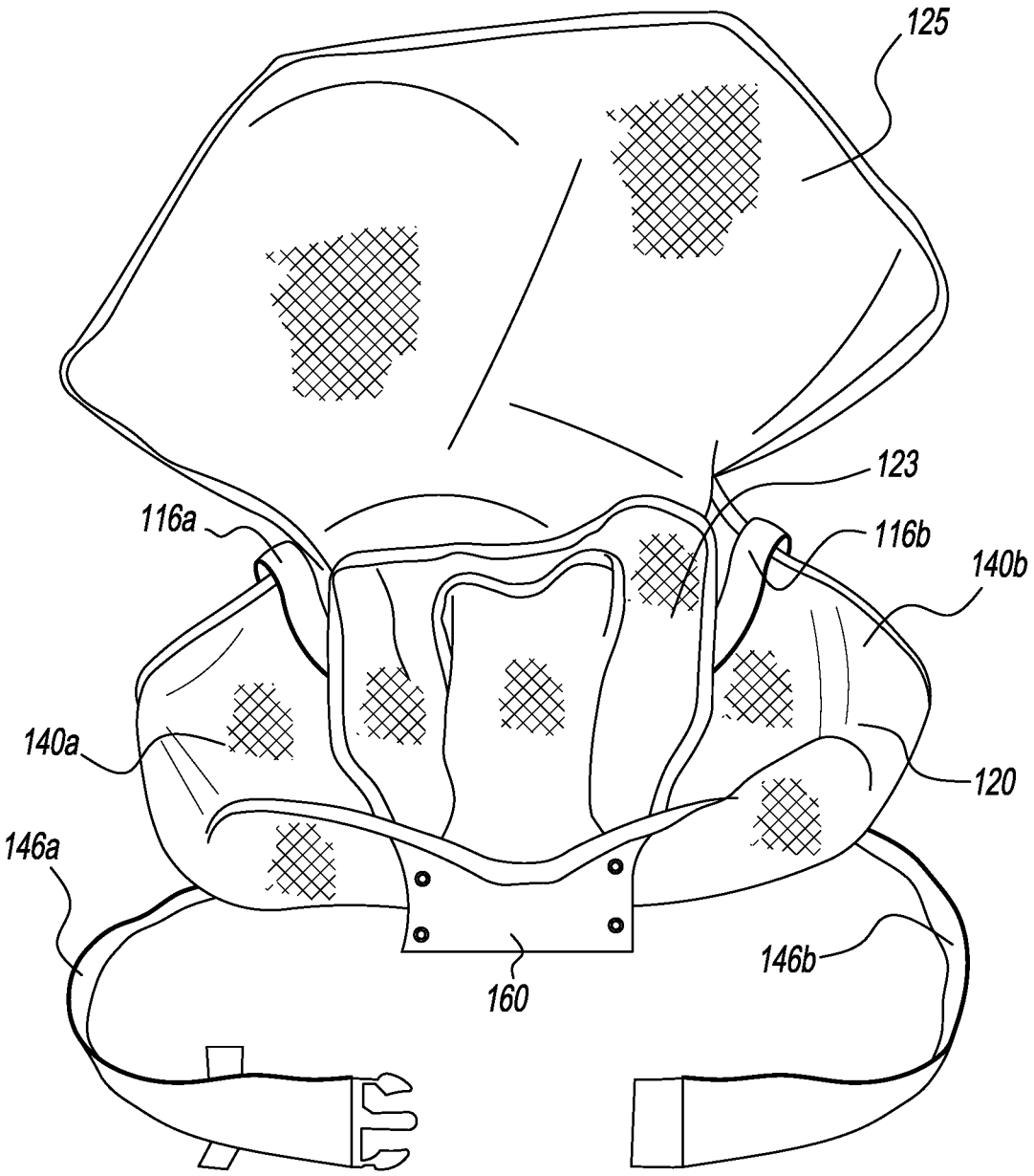
FIG. 7 is a frontal view of the multiple position baby carrier of FIG. 1, illustrating the cradle assembly and carriage in a generally open position and an attachable cover in an extended position for covering a baby during nursing.
Figure 8:
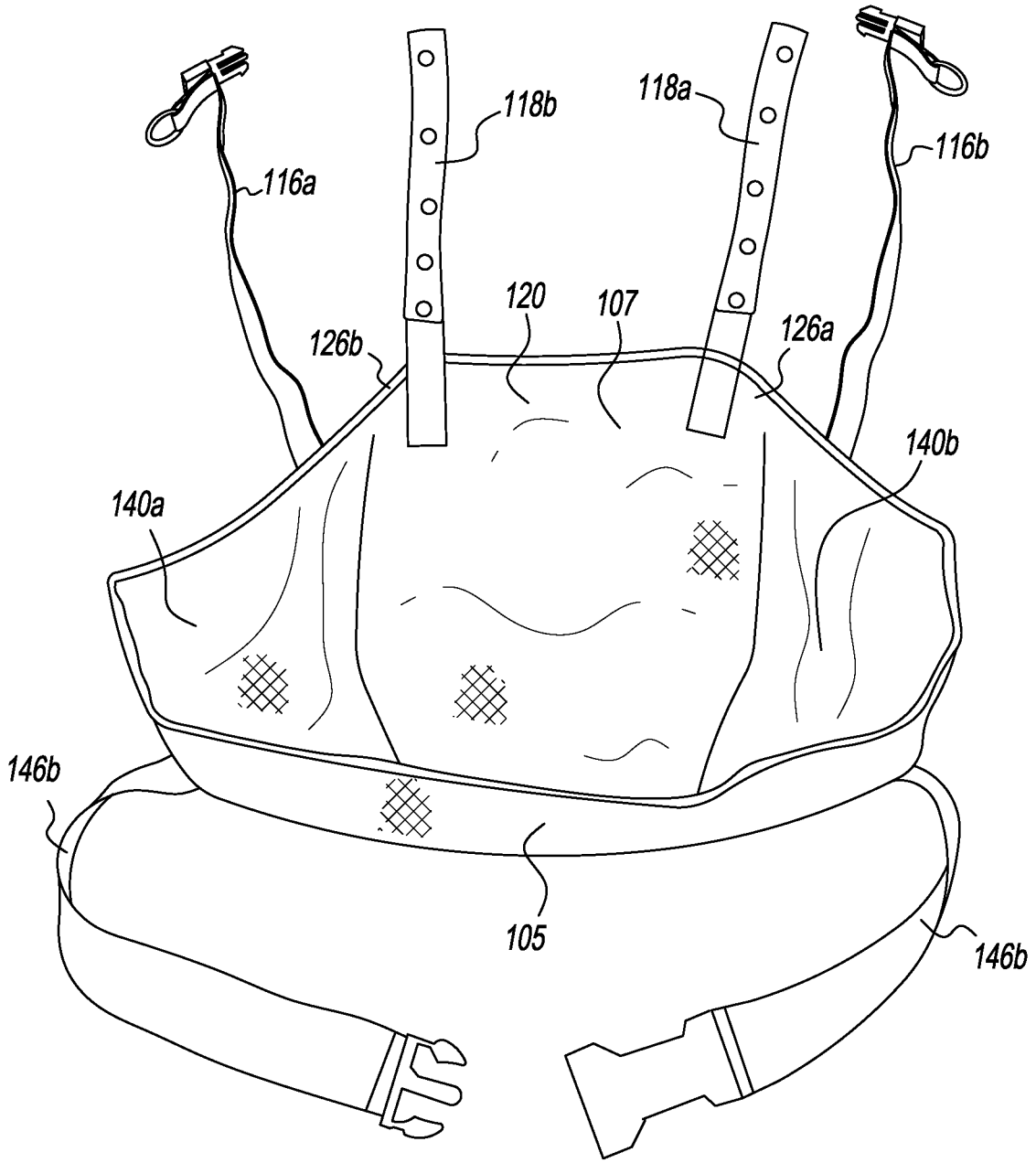
FIG. 8 is a top perspective view of the carrier of FIG. 1 illustrating in detail the configuration of the cradle assembly and specifically the carriage member with adaptable flap members in an extended position.

FIGS. 7 and 8 illustrate the outer frontal portion of the carriage assembly 120. As illustrated, the carriage assembly 120 includes a first outer compartment 124 suitable containing a privacy member 128 and a second outer compartment 126 positioned on the exterior of the first outer compartment 124 suitable for containing items. The carriage 120 is configured to permit a baby to be supported in at least seven different positions. The carriage 120 is foldable and flexible into different configurations such that in conjunction with the strap members, the carriage is capable of supporting the baby B in at least seven positions.

Figure 9:
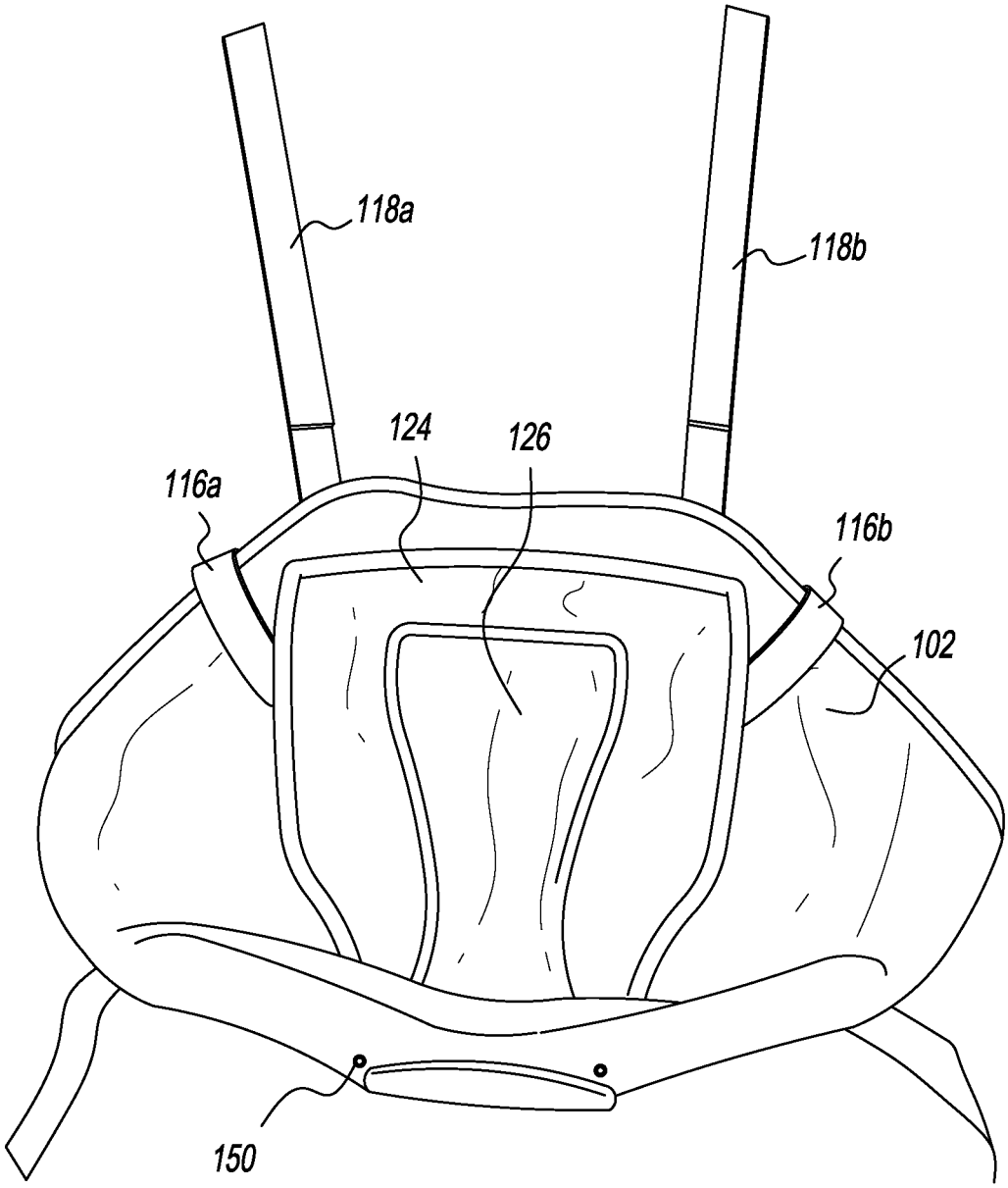
FIG. 9 is a frontal view of the multiple position baby carrier.

FIGS. 8-9 illustrate the interior configuration of the carriage 120 assembly. As illustrated, the carriage 120 has a generally concave or U-shaped configuration suitable for supporting and receiving a baby therein. The carriage 120 interior has end flap members 140*a*, 140*b* suitable for adjustable folding therein to support the baby in different position. As illustrated, the carriage member 120 also has a first side 105 forming an outer edge portion and an opposing second side 107 forming and inner edge portion proximate. In cooperation the first side 105, second side 107 and end flap members 140*a*, 140*b* flexibly form a concave shape. The incurvate flexible shape of the carriage 120 provides versatility permitting the user to form the carriage 120 in configurations suitable for swaddling as well as supporting the baby B in seven different positions.

As previously shown in FIGS. 2A and 2B the carriage assembly 120 supports a baby in a first position, supporting the baby in an opposite facing position wherein the baby's legs extend out of the carriage 120. In a second position, or semi cradle position, shown in FIGS. 3A and 3B the baby's legs are contained generally horizontally within the carriage assembly 220 and can be encased in a check mark configuration.

Figure 10:
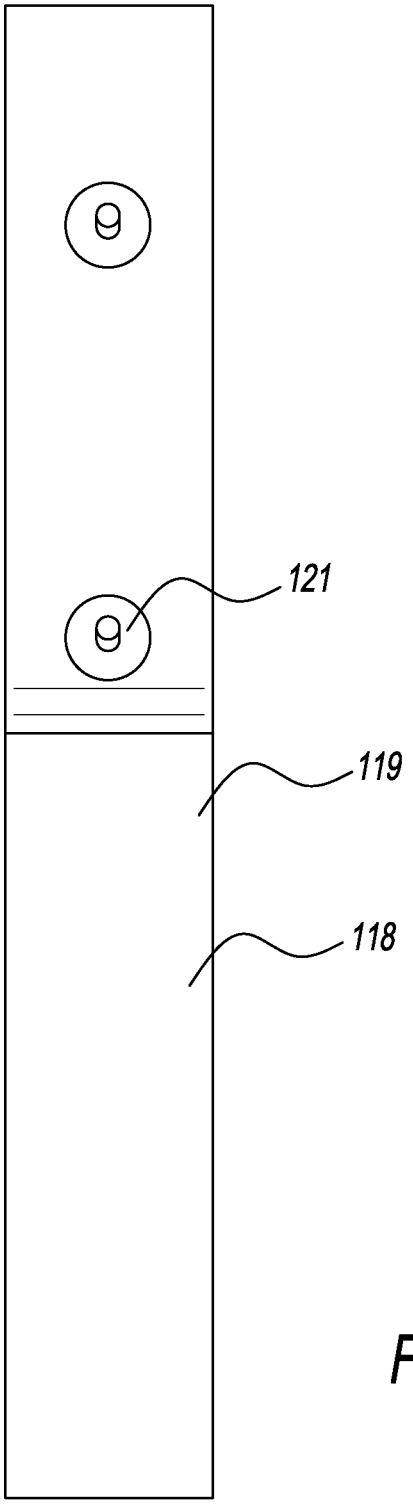
FIG. 10 is a detailed view of the adjustable strap member having connecting members and elastic portions for adjustment.

FIG. 10 illustrates the adjustable support straps are affixed to the generally top side portions (or corners) of the carrier. By position these straps to the upper portion, the straps support the upper portion of the carriage 120 providing head support to provide head support for an infant and upper back support to an older baby or toddler when positioned in the carrier As illustrated, elastic 119 is affixed to the base of the support straps. Further snap-like fastening members may be provided to the straps to facilitate customizable head or upper back support.

Figure 11:
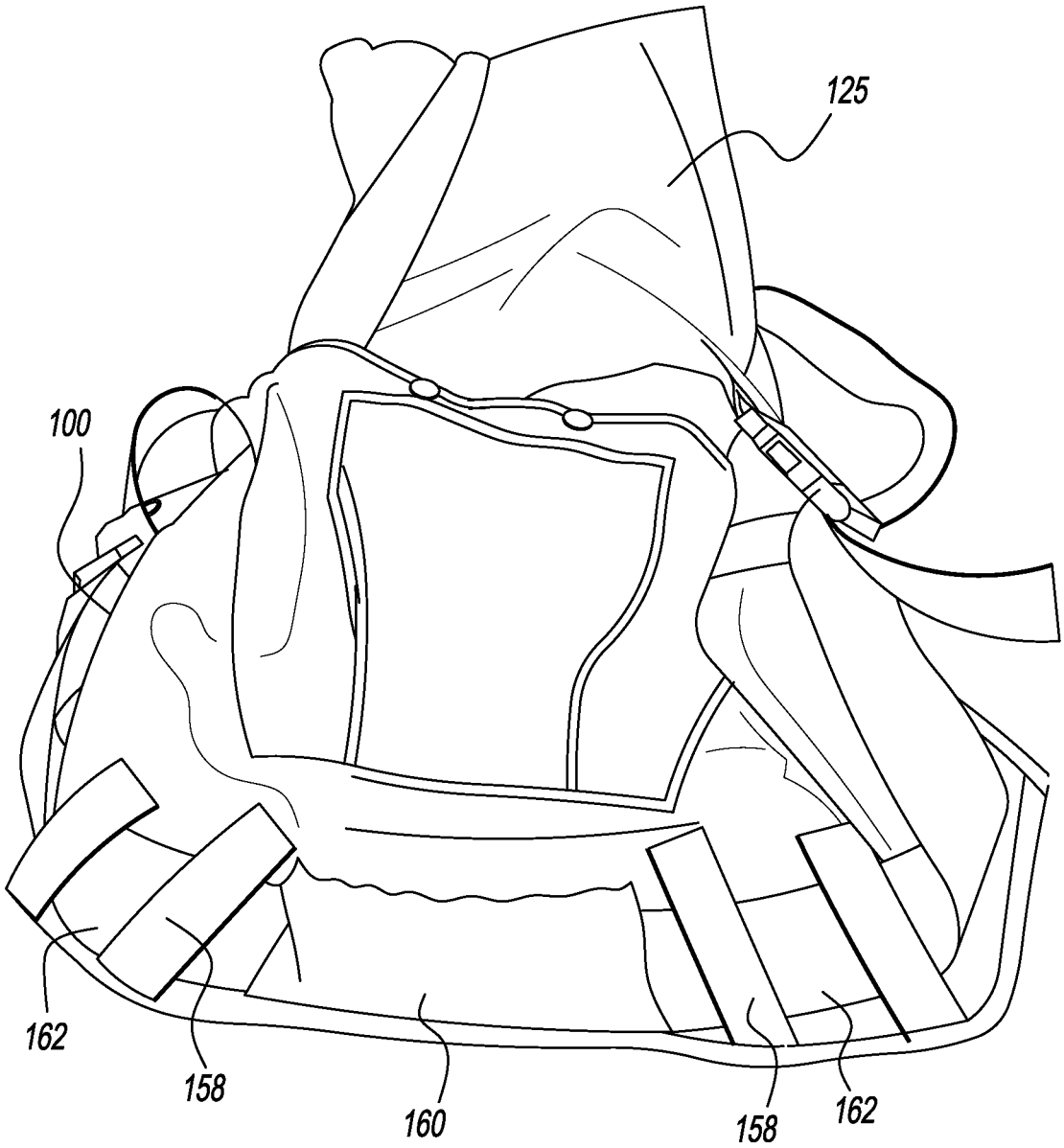
FIG. 11 is a perspective view of a lower portion of the multiple position baby carrier of FIG. 1 illustrating waistband and leg strap members connection to the carrier.
Figure 12:
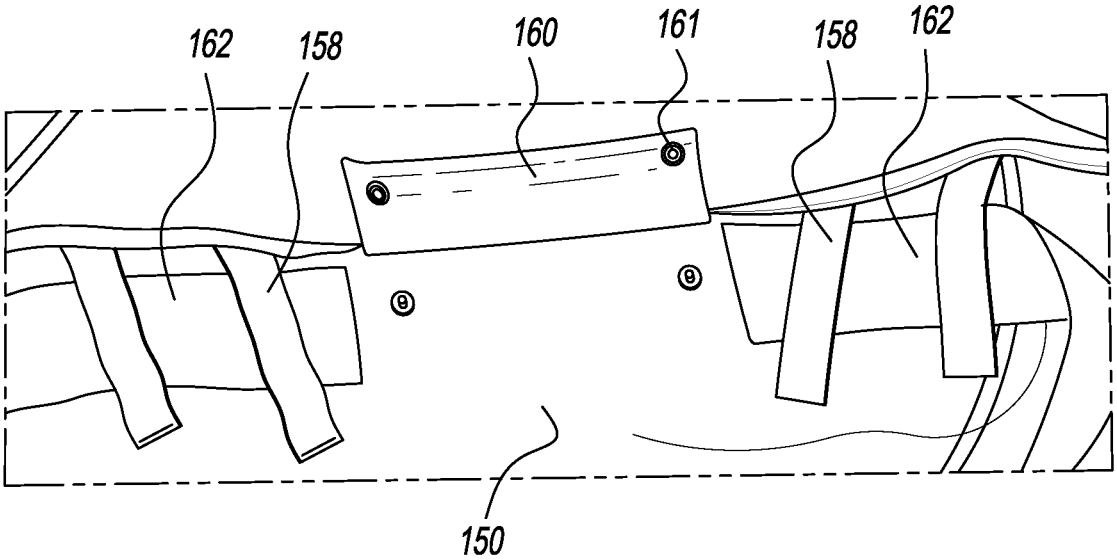
FIG. 12 is a detailed view of the lower portion and waist band member of the carrier of FIG. 1.
Figure 13:
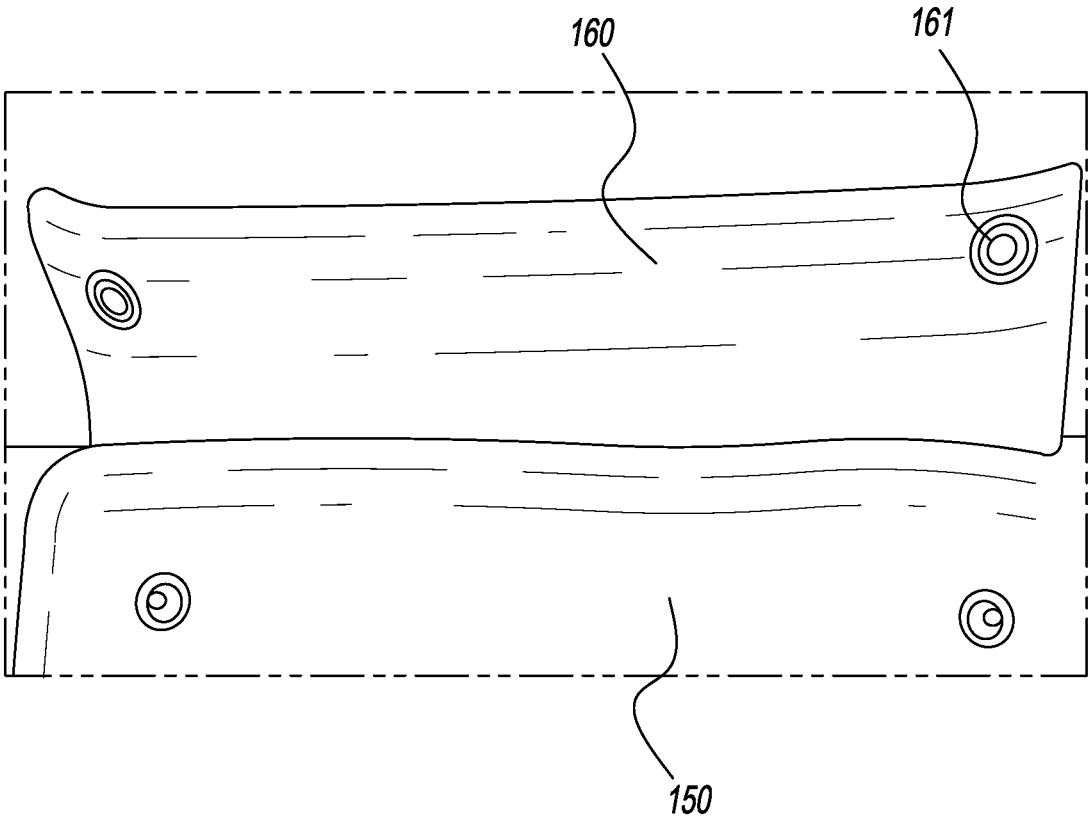
FIG. 13 is a detailed view of the lower cushion member and attachable connecting features.
Figure 14:
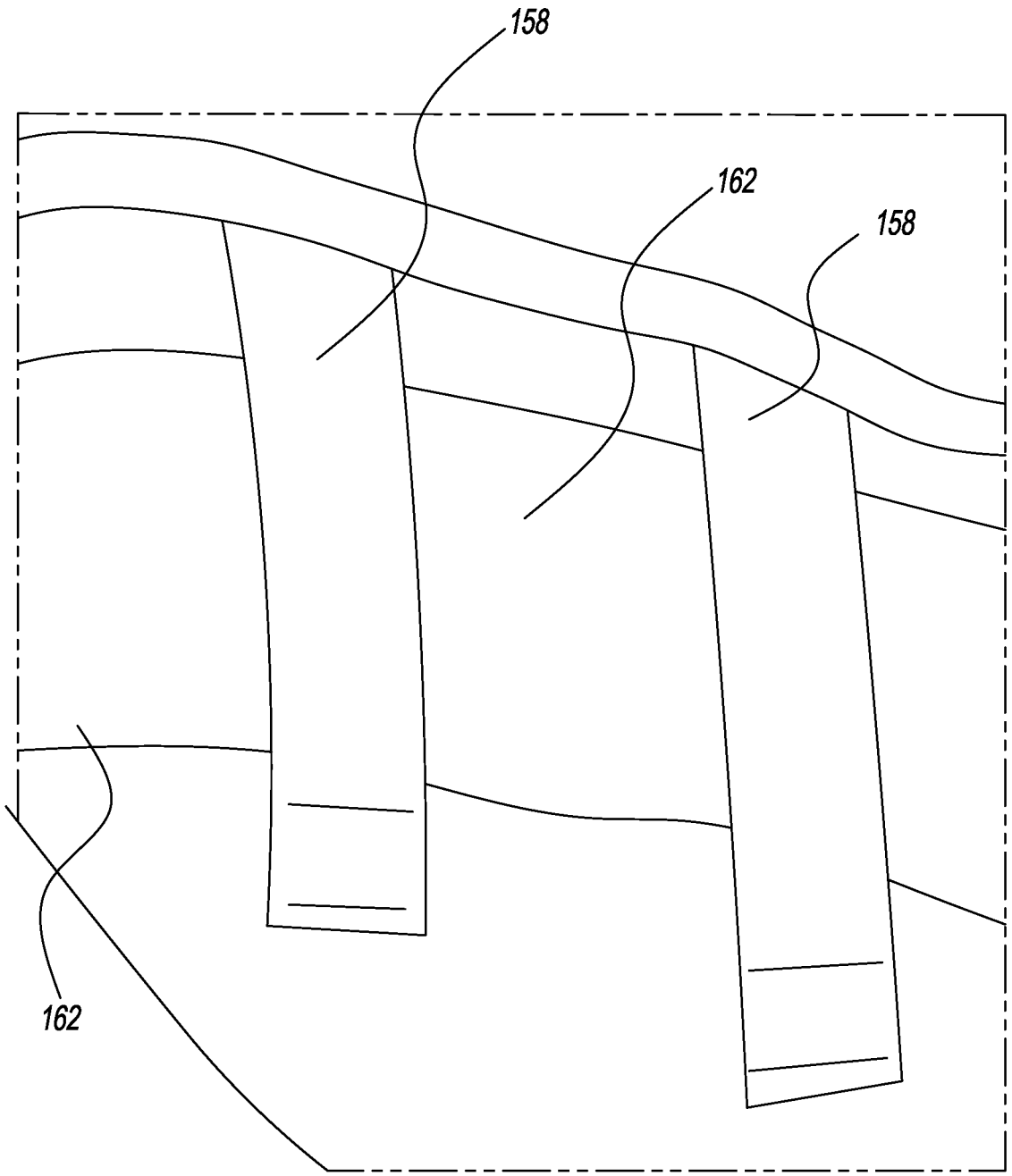
FIG. 14 is a detailed view of the leg strap members and torso member configured for receiving the waist band strap member therein.

As illustrated in FIG. 11, the carriage 120 assembly includes leg support straps 158 on the exterior of the carriage 120 configured for supporting the legs of the infant in cooperation with the adjustable waist strap. As illustrated in FIGS. 11, 12 and 14, the adjustable waist straps 162 may be fed through the leg support straps 158. This is helpful at various stages of baby's development. The leg support straps 158 provide extra support for baby's legs to maintain the "M" upright seated, or squat seated position as the baby grows to 35 pounds as illustrated in FIGS, when the baby is positioned in an upright position. It is contemplated that no leg support straps are necessary to be used for newborns under three (3) months.

A waist pad 160 with snaps 161 at the lower portion of the carriage 120 portion and can be extended to provide support and cushion to the interior of the carriage 120 as it engages the user's torso.

FIG. 1 illustrates a generally hexagonally shaped attached cover which reinforces the hexagon brand logo. The attachable cover 170 is multi-functional as it may be is used for shade against the sun, wind cover, or a privacy option when breastfeeding. There are male snaps 171 at the bottom edge of the attachable cover 170 to attach it to the inside edge of the larger front pocket. There is one male snap 173 centered generally at the top of the attachable cover 170 so it can be attached to either of the two female snaps 180 located on each respective vest back shoulder strap 104*a*, 104*b*.

Figure 15:
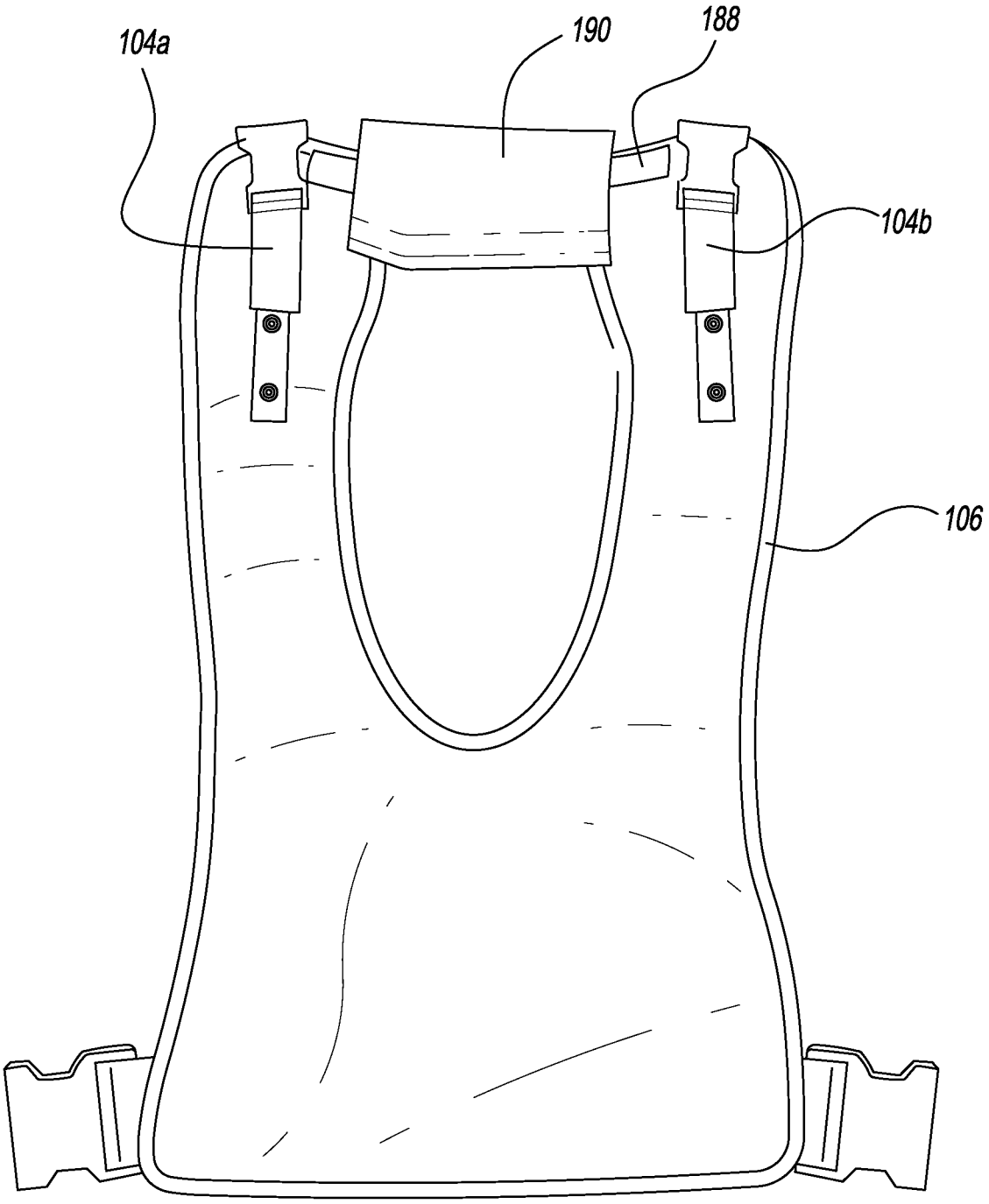
FIG. 15 is a detailed view of the vest back member with shoulder strap member and padding member.

FIG. 15 illustrates a detailed view of the vest back assembly 106 with the two female snaps or connecting members 180 provided on each respective shoulder strap 104. The connecting members 108 may be used to secure the respective support straps 118*a*, 118*b* and the attachable cover to either shoulder strap 104*a*, 104*b*.

Figure 16:
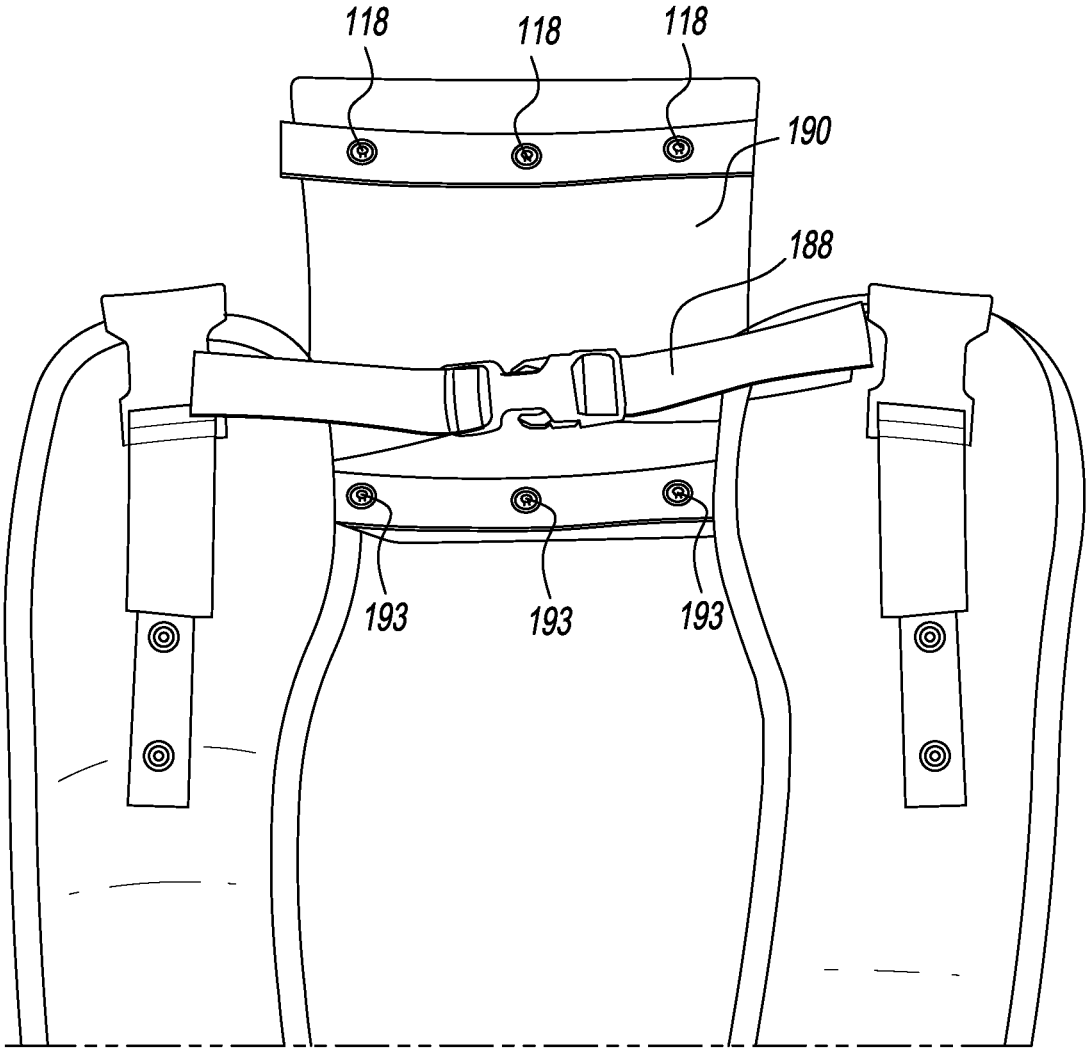
FIG. 16 is a detailed view of the shoulder strap member and removable strap covers, or padding member, provided on an intermediate strap member.

As illustrated in FIG. 16, the intermediate connecting strap 188 may include a waterproof chewable chest strap padded cover 190 secured by three or more connecting members 193 or snaps. The strap 188 and cover 190 provides a soft, waterproof place/surface for a baby's B face and mouth to engage when the multiple position baby carrier 100 is worn centered on the wearer's body. As baby's B often chew on what's nearest their mouth and this waterproof strap 188 and cover 190 keeps moisture off the chest strap 188 and the wearer's skin or clothes. For convenience, the cover 190 is easily removed and machine washable.

As discussed, the nursing carrier 100 has multiple strap and harnessing members, and as such, nursing carrier 100 may be configured to support the baby B in at least seven (7) different positions relative to the user. This is what separates the multiple position baby carrier 100 from other carriers. As previously shown in FIG. 2, the nursing carrier 100 may support the baby B in a first position, which is in a generally upright opposing facing position relative to the user. The baby B is positioned in an upright position with the baby's lower portion or buttocks positioned in the interior portion of the carriage 120 and baby's legs extend generally downward therefrom, in engagement with, and supported by the strap members 146. Accordingly, the baby's back rests generally against the inner portion of the carriage 120 and the baby's torso faces the user's torso.

Figure 17:
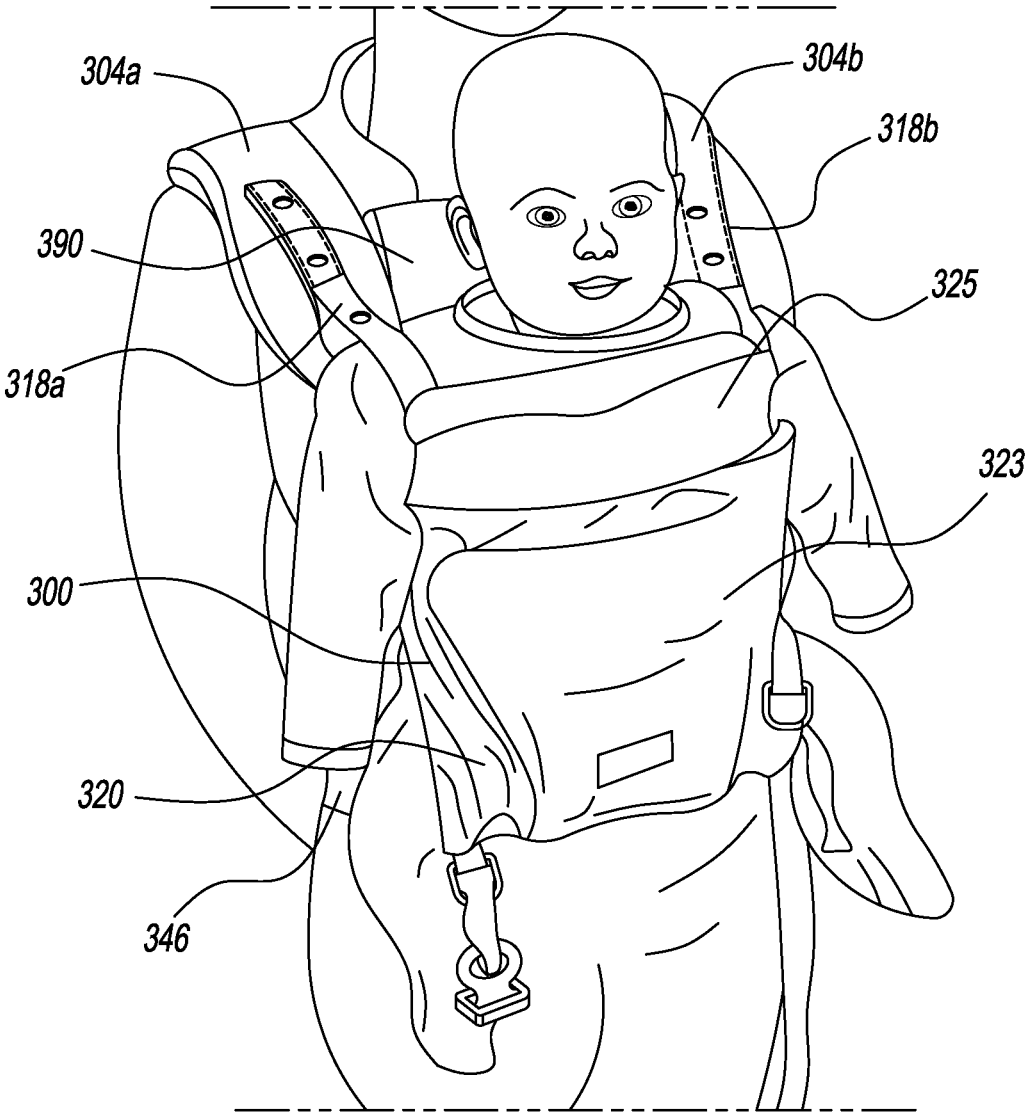
FIG. 17 is a perspective view of the multiple position carrier supporting the baby in a generally upright front facing position relative to the user, or third position.

In another configuration, FIG. 17 illustrate the carrier 300 supporting the baby B in a generally front facing position relative to the user, or a third position. Similar to the opposite facing, the baby is positioned in an upright position with the baby's buttocks positioned in the carriage 320 and legs extending generally downward, in engagement with members 146. However, in this configuration the baby B front torso portion engages the inner portion of the carriage 320 and the back portion of the baby B may rest against the torso. The baby is positioned in carriage 320 in a front facing positing with straps 346 supporting the baby's legs and the baby's head is supported by the padded member 390. Straps 318*a*, 318*b* and shoulder strap members 304*a*, 304*b* support the cradle assembly 302 and carriage 320.

Figure 18:
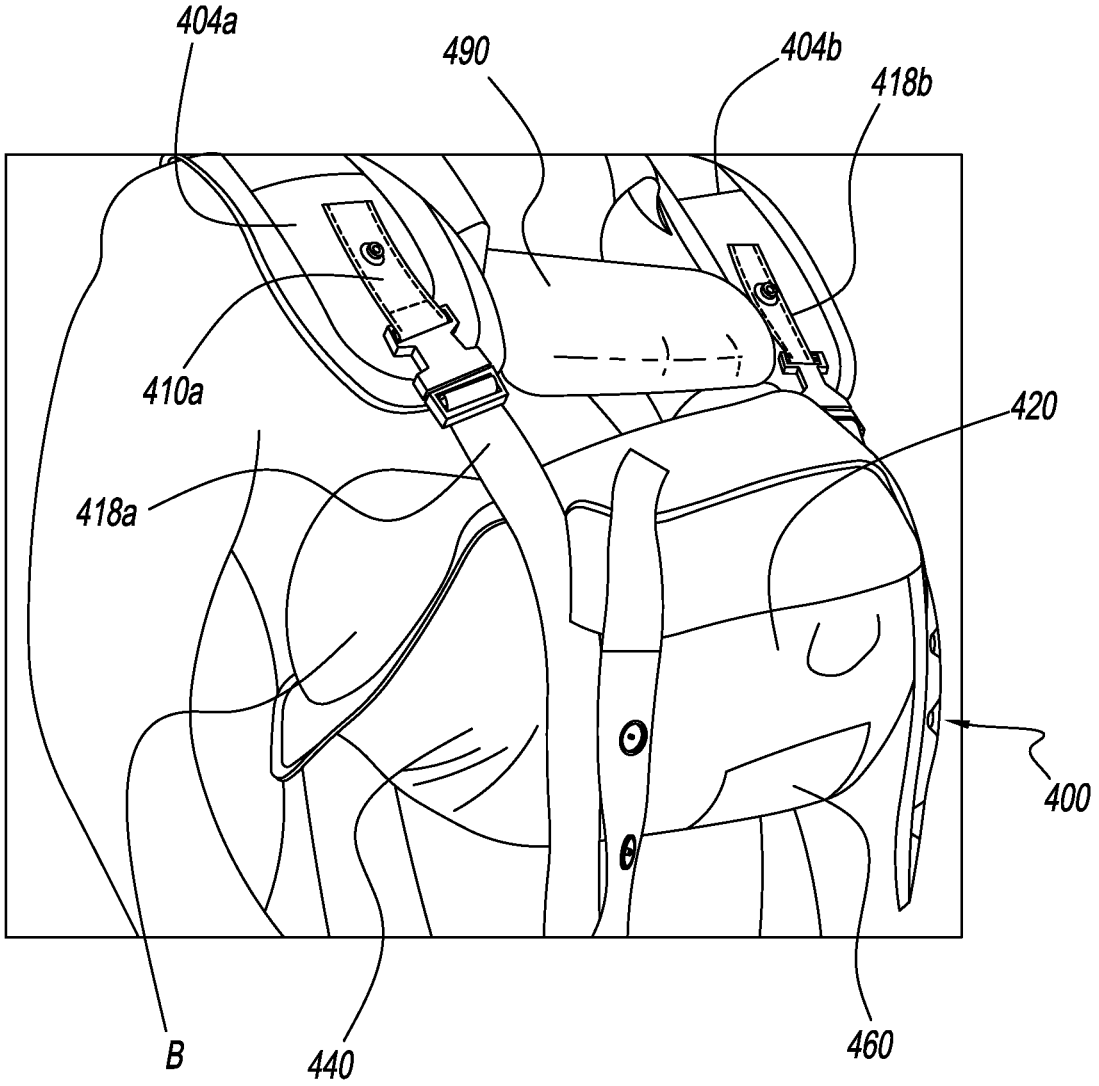
FIG. 18 is a perspective view of the nursing carrier supporting a baby in a generally horizontal cradle position, or fourth position, with one or both outer flap portions of the carriage extended providing head support to the baby.

FIG. 18 illustrates the baby carrier 400 configured to hold the baby B in a horizontal swaddled position, or fourth position. The baby B traverses the user's body. In this configuration, flap member 440 of the carriage 420 extends outward supporting the baby's head. An opposing flap member 440 may be tucked inside of the cradle assembly 402 to contain the baby's feet therein, if desired. Shoulder members 404*a*, 404*b* and strap members 418*a*, 418*ab* support the cradle assembly 402.

Figure 19:
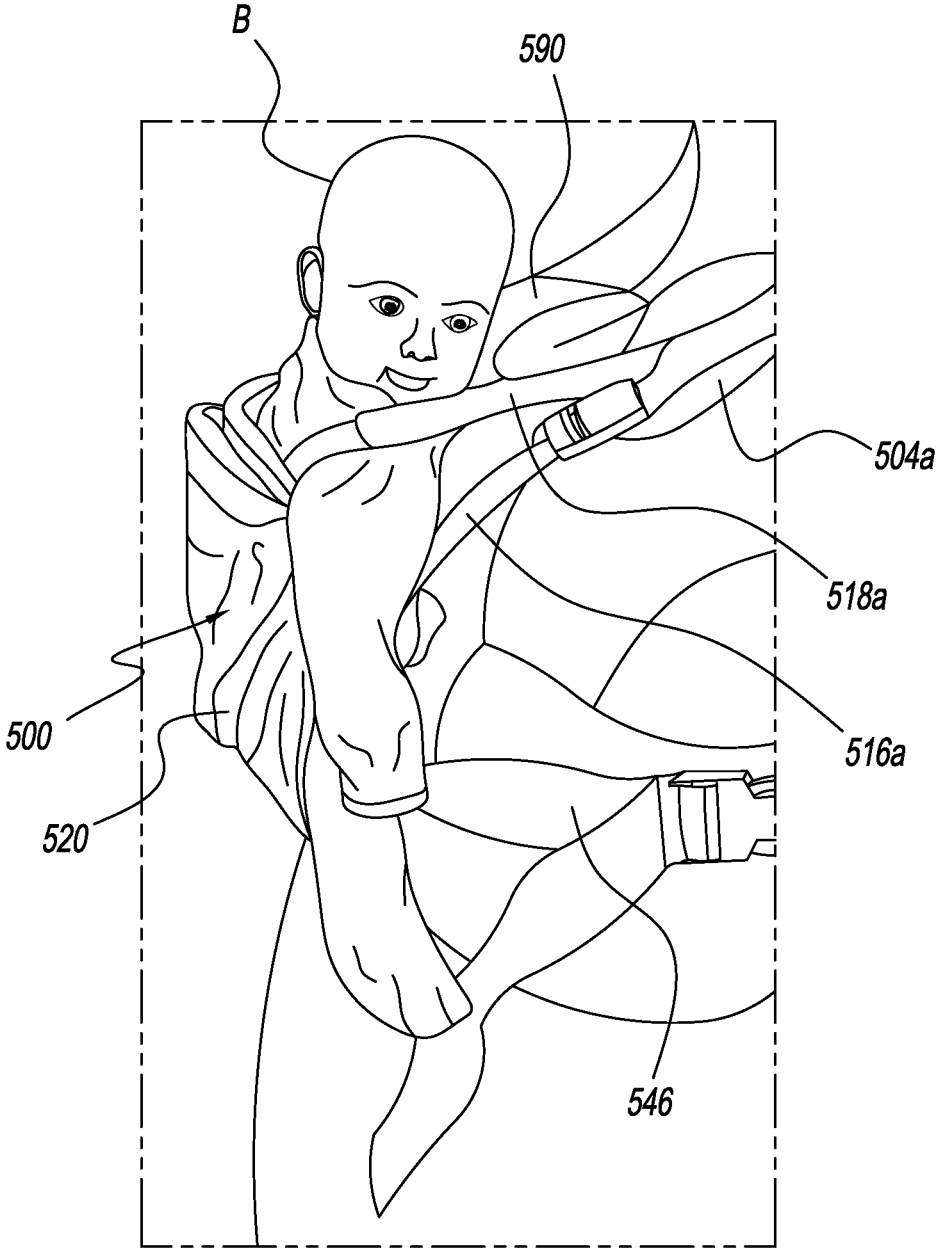
FIG. 19 is a perspective view of the carrier having retracted straps to permit the baby to be supported within the carriage wherein the baby is positioned on the hip of the user in a fifth position.

FIG. 19, the baby carrier 500 and baby B inside the carriage 520 may be configured to be selectively positioned on the user's hip to supporting the baby in a generally upright position on the user's hip, or fifth position. This is achieved by positioning the child in the carrier in a generally side facing upright position and adjusting the strap members 518*a*, 518*b* and strap members 516*a*, 516*b* to retract one side of the user's body pulling the carrier closer to the user and retracted on another side of the user's body permitting the carriage 520 portion and baby held inside to be supported proximate to the user's selected hip.

Figure 20:
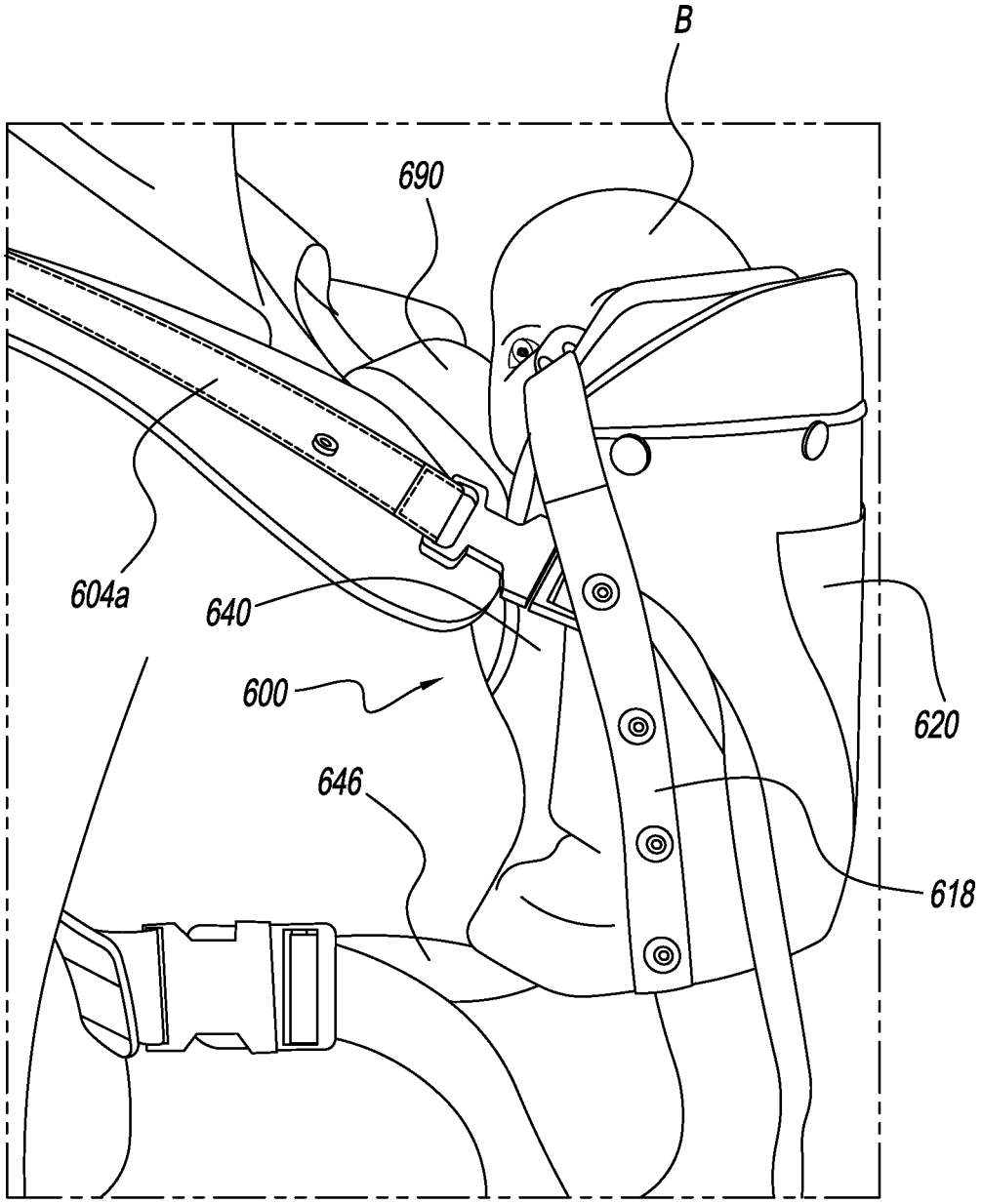
FIG. 20 is a perspective view of the carrier supporting the baby in an upright swaddled position, or sixth position, with flaps of the carriage folded inside the cradle assembly generally between the baby and the user and strap members securing the carriage in baby swaddling configuration.

FIG. 20, illustrates the multiple position baby carrier 600 positioned in a fifth configuration for supporting the baby in an upright generally vertical, swaddled position, or fifth position. In this configuration, the flaps portions 640*a*, 640*b* of the carriage 620 are folded inside the carriage 620 generally between the baby B. The flaps 640*a*, 640*b* form an encasement surrounding the baby B, providing a swaddling encasement for the baby B. The adjustably inner portion of the carriage supports the baby's legs therein the carriage 620. Strap members 618 are connectable to members 161, 160 such that the straps 618 maintain the structure of the swaddle formation.

Figure 21:
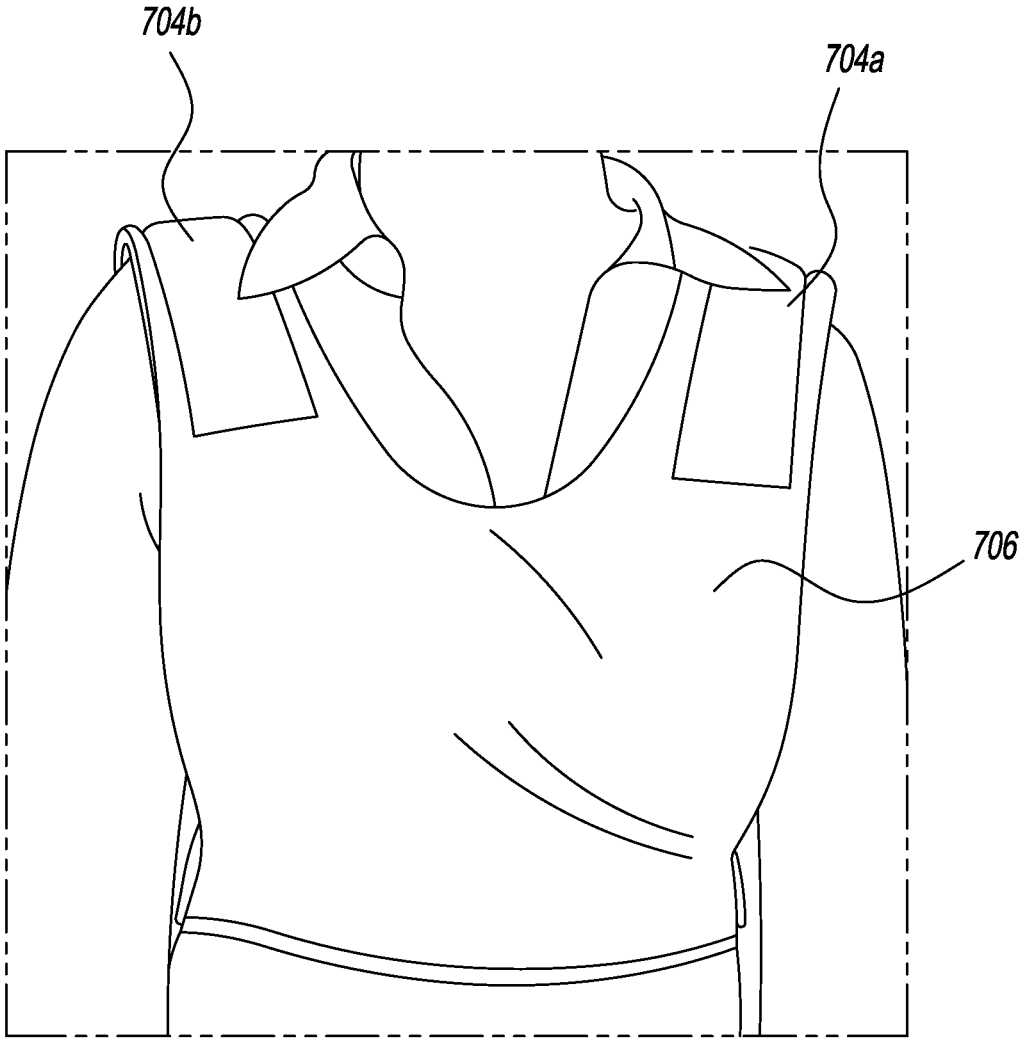
FIG. 21 illustrates a perspective frontal view of the user having the multiple position baby carrier configured in a seventh position, wherein the vest back is positioned on the frontal portion of the user's torso and the carriage and cradle assembly is positioned on the back of the carrier for supporting and carrying the baby on the back of the user; and, FIG. 22 illustrates a back perspective view of the multiple position baby carrier with the carriage and cradle assembly positioned on the back of the user, in a seventh position, for supporting a baby in a generally on the user's back.
Figure 22:
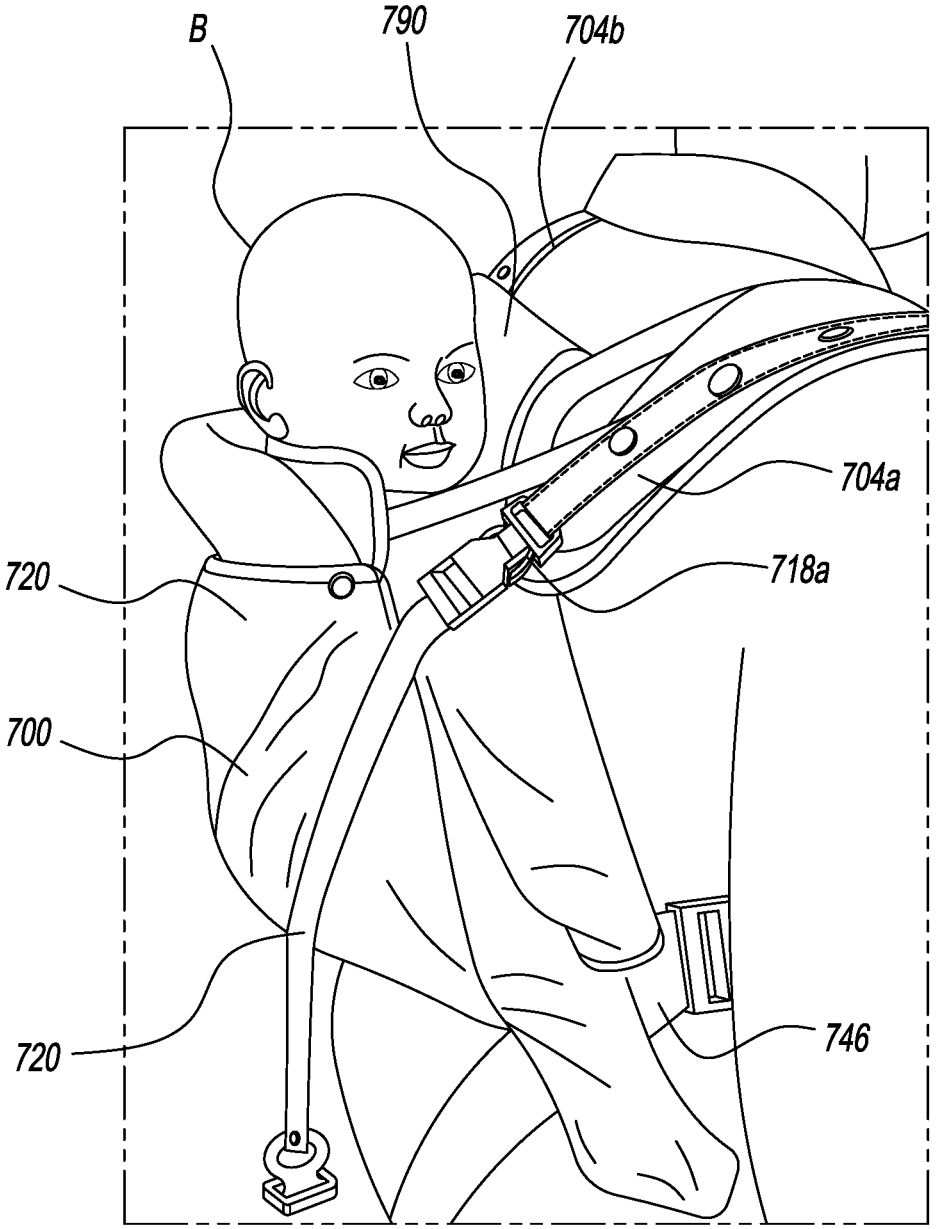

FIGS. 21-22 shows the user with the multiple position baby carrier 700 with the vest back 706 positioned on the frontal portion of the user's torso to support the baby B positioned in the carriage 720 on the back of the user. As shown, the multiple position baby carrier with the carriage 720 portion positioned on the back of the user for supporting a baby in a generally upright position on the user's back.

FIG. 22 illustrates a back view of the multiple position baby carrier with the carriage 720 portion positioned on the back of the user for supporting a baby in a generally upright. As illustrated, straps 746 are used to support the baby's legs which hang in a generally downward position. The first side 707 of the carriage 720 engages the baby's back and the second side 705 (not shown) engages the baby's front. Cover 790 provides support to the baby's head. Straps 704*a*, 704*b* are adjustable to raise the height of the baby relative to the user's back.

What is claimed is:

1. A carrier for holding an infant, the carrier comprising:

a carriage assembly comprising: an adjustable carriage pocket, wherein a size of the adjustable carriage pocket is adjustable to support the infant in a cradle position in which a direction from a head of the infant to a hip of the infant is substantially perpendicular to a direction from a head of a user to a hip of the user; and a back support assembly removably connected to the carriage assembly, wherein the adjustable carriage pocket comprises a first flap, a second flap, a third flap, and a fourth flap, wherein in the cradle position, the third flap defines a first space to support a back or a head of the infant, wherein in the cradle position the fourth flap defines a second space to support or encase a foot of the infant, and wherein in an upright position, the third flap and the fourth flap are folded such that the first flap and the second flap support the upright position in which the direction from the head of the infant to the hip of the infant is substantially same as the direction from the head of the user to the hip of the user.

2. The carrier of claim 1, wherein the second flap is connected to the first flap, and wherein the first flap and the second flap flexibly form a substantial U-shape for holding the infant.

3. The carrier of claim 2, wherein the third flap connects the first flap to the second flap; and the fourth flap connects the first flap to the second flap, wherein the first flap, the second flap, the third flap, and the fourth flap flexibly form a concave shape.

4. The carrier of claim 3, wherein the third flap and the fourth flap in connection with the first flap and the second flap define a space for the third flap to support the back of the infant and for the fourth flap to encase the foot of the infant.

5. The carrier of claim 3, wherein the third flap and the fourth flap are adjustably foldable to support the upright position in which the direction from the head of the infant to the hip of the infant is substantially same as the direction from the head of the user to the hip of the user.

6. The carrier of claim 2, wherein the carriage assembly further comprises a pair of first straps attached to the first flap to support a torso of the infant in an upright position in which the direction from the head of the infant to the hip of the infant is substantially same as the direction from the head of the user to the hip of the user, and wherein the pair of first straps is removably connected to the back support assembly.

7. The carrier of claim 1, wherein the back support assembly further comprises a torso support removably connected to the carriage assembly for securely supporting the carriage assembly on a torso or the hip of the user.

8. A carrier for holding an infant, the carrier comprising:

a carriage assembly comprising: an adjustable carriage pocket, wherein a size of the adjustable carriage pocket is adjustable to support the infant in a cradle position in which a direction from a head of the infant to a hip of the infant is substantially perpendicular to a direction from a head of a user to a hip of the user, and a back support assembly removably connected to the carriage assembly, wherein the adjustable carriage pocket comprises a first flap and a second flap connected to the first flap, and wherein the first flap and the second flap flexibly form a substantial U-shape for holding the infant, wherein the carriage assembly further comprises a pair of first straps attached to the first flap to support a torso of the infant in an upright position in which the direction from the head of the infant to the hip of the infant is substantially same as the direction from the head of the user to the hip of the user, wherein the pair of first straps is removably connected to the back support assembly, wherein the carriage assembly further comprises a pair of second straps attached to the first flap to support the head of the infant or an upper portion of the torso of the infant, and wherein the pair of second straps is removably connected to the back support assembly.

9. The carrier of claim 8, wherein the back support assembly comprises a pair of shoulder straps removably connected to the pair of the first straps, and wherein the pair of shoulder straps removably connected to the pair of the second straps.

10. The carrier of claim 9, wherein the pair of second straps comprises a pair of snap fasteners for removably connecting the pair of second straps to the pair of shoulder straps.

11. A carrier for holding an infant, the carrier comprising:

an adjustable carriage pocket, wherein a size of the adjustable carriage pocket is adjustable to support the infant in a cradle position in which a direction from a head of the infant to a hip of the infant is substantially perpendicular to a direction from a head of a user to a hip of the user, wherein the adjustable carriage pocket comprises a first flap and a second flap connected to the first flap, and wherein the first flap and the second flap flexibly form a substantial U-shape for holding the infant, wherein the adjustable carriage pocket further comprises a third flap and a fourth flap, wherein in the cradle position, the third flap defines a first space to support a back or a head of the infant and wherein in the cradle position the fourth flap defines a second space to support or encase a foot of the infant, wherein in an upright position, the third flap and the fourth flap are folded such that the first flap and the second flap support the upright position in which the direction from the head of the infant to the hip of the infant is substantially same as the direction from the head of the user to the hip of the user.

12. The carrier of claim 11, wherein the third flap connects the first flap to the second flap and the fourth flap connects the first flap to the second flap, wherein the first flap, the second flap, the third flap, and the fourth flap flexibly form a concave shape.

13. The carrier of claim 12, wherein the third flap and the fourth flap in connection with the first flap and the second flap define a space for the third flap to support the back of the infant and for the fourth flap to encase the foot of the infant.

14. The carrier of claim 12, wherein the third flap and the fourth flap are adjustably foldable to support the upright position in which the direction from the head of the infant to the hip of the infant is substantially same as the direction from the head of the user to the hip of the user.

15. The carrier of claim 11, further comprising: a pair of first straps attached to the first flap to support a torso of the infant in an upright position in which the direction from the head of the infant to the hip of the infant is substantially same as the direction from the head of the user to the hip of the user.

16. The carrier of claim 15, further comprising: a pair of second straps attached to the first flap to support the head of the infant or an upper portion of the torso of the infant.

17. The carrier of claim 16, further comprising: a back support assembly removably connected to the adjustable carriage pocket, wherein the back support assembly comprises a pair of shoulder straps removably connected to the pair of the first straps, and wherein the pair of shoulder straps removably connected to the pair of the second straps.

18. The carrier of claim 17, wherein the pair of second straps comprises a pair of snap fasteners for removably connecting the pair of second straps to the pair of shoulder straps.

19. The carrier of claim 17, wherein the back support assembly further comprises a torso support removably connected to the adjustable carriage pocket for securely supporting the adjustable carriage pocket on a torso or the hip of the user.

* * * * *